US008691738B2

(12) United States Patent
Baillargeon et al.

(10) Patent No.: US 8,691,738 B2
(45) Date of Patent: Apr. 8, 2014

(54) METHOD FOR IMPROVING THE CORROSION INHIBITING PROPERTIES OF LUBRICANT COMPOSITIONS

(75) Inventors: David J. Baillargeon, Cherry Hill, NJ (US); Marc-André Poirier, Cherry Hill, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 592 days.

(21) Appl. No.: 12/799,867

(22) Filed: May 4, 2010

(65) Prior Publication Data

US 2010/0273691 A1 Oct. 28, 2010

Related U.S. Application Data

(63) Continuation of application No. 11/637,343, filed on Dec. 12, 2006, now abandoned.

(60) Provisional application No. 60/750,550, filed on Dec. 15, 2005.

(51) Int. Cl.

| | |
|---|---|
| ***C10M 169/04*** | (2006.01) |
| *C10M 105/02* | (2006.01) |
| *C10M 107/02* | (2006.01) |
| *C10M 133/28* | (2006.01) |
| *C10M 133/44* | (2006.01) |
| *C10M 137/04* | (2006.01) |
| *C10M 101/02* | (2006.01) |

(52) U.S. Cl.

CPC ..... *C10M 169/04* (2013.01); *C10M 105/02* (2013.01); *C10M 107/02* (2013.01); *C10M 133/28* (2013.01); *C10M 133/44* (2013.01); *C10M 137/04* (2013.01); *C10M 2203/108* (2013.01); *C10M 2205/003* (2013.01); *C10M 2207/003* (2013.01); *C10M 101/02* (2013.01)

USPC ..... 508/110; 508/184; 508/279; 508/441

(58) Field of Classification Search

CPC ..... C10M 101/02; C10M 105/02; C10M 107/02; C10M 133/28; C10M 133/44; C10M 137/04; C10M 2203/108; C10M 2205/003; C10M 2207/003

USPC ..... 508/110, 184, 279, 441

See application file for complete search history.

(56) References Cited

U.S. PATENT DOCUMENTS

| | | | | |
|---|---|---|---|---|
| 6,180,575 | B1 | 1/2001 | Nipe | |
| 6,207,623 | B1 | 3/2001 | Butler et al. | |
| 6,251,840 | B1 * | 6/2001 | Ward et al. | 508/162 |
| 2003/0158055 | A1 * | 8/2003 | Deckman et al. | 508/571 |
| 2005/0153850 | A1 * | 7/2005 | Nelson et al. | 508/300 |
| 2005/0245402 | A1 * | 11/2005 | Yagishita | 508/185 |

* cited by examiner

*Primary Examiner* — Taiwo Oladapo
(74) *Attorney, Agent, or Firm* — Robert A. Migliorini

(57) ABSTRACT

Lubricating oils of improved initial and long term metal corrosion inhibiting properties comprises a base stock containing one or more hydrodewaxate or hydroisomerate base stock(s) and/or base oil(s), GTL base stock(s) and/or base oil(s), or mixtures thereof, preferably GTL base stock(s) and/or base oil(s), boiling in the lubricating oil boiling range and an additive amount of an anti-corrosion additive.

7 Claims, No Drawings

METHOD FOR IMPROVING THE CORROSION INHIBITING PROPERTIES OF LUBRICANT COMPOSITIONS

CROSS-REFERENCE TO RELATED APPLICATIONS

This application is a continuation of United States Non-Provisional patent application Ser. No. 11/637,343, filed Dec. 12, 2006 now abandoned, which claims the benefit of U.S. Provisional Patent Application Ser. No. 60/750,550 filed Dec. 15, 2005.

FIELD OF THE INVENTION

The present invention relates to a method for improving the metal corrosion resistance of lubricating oils.

BACKGROUND OF THE INVENTION

Lubricating oils perform numerous functions. In engines they function to reduce friction and wear of numerous parts in moving contact with each other such as piston rings and cylinder walls, valves, cams, bearings, etc. They also function to cool the engine by operating as a heat sink and to clean the engine by carrying away combustion products and engine wear debris. Consequently engine oils accumulate various and numerous contaminants which are or can be harmful to the engine. Similarly, engine oils by being exposed to extremes of heat are subjected to oxidation which further increases the concentrations of various contaminants in the oil. The same can be said for lubricating oils other than engine oils. Transmission fluids, hydraulic oils, gear oils, turbine oils, functional fluids, industrial oils all function to lubricate parts in moving relationship with each other and in the course of their use accumulate various contaminants which are or can be harmful to the parts being lubricated.

One of the types of damage which can be caused by contaminants in lubricating oils which accumulate in the oils over time or which can even be caused by additives added to the oil to achieve some otherwise desirable end result, such as anti-wear additives, is corrosion of the ferrous and non-ferrous metal parts of the apparatus or device being lubricated. Metal corrosion, therefore can occur at any time in the course of using the lubricating oil. Corrosion can occur at the very beginning of the lubricating process if the oil contains an additive which, while desirable for some purpose such as antiwear or friction reduction, also by its very chemical make-up is corrosive to metal, or the oil can become corrosive over time as contaminants build up in the oils as a consequence of accumulation of combustion products (and their conversion into corrosive materials) or during lubricant aging, oxidation and normal deterioration.

Equipment manufacturers, as well as oil formulators, therefore, are faced with the dual problems of corrosion caused by additives as well as by contaminants. Finding a cure for such initial and long term metal corrosion problems, especially with the current impetus for extended oil drain intervals and sealed for life lubrication has fostered numerous solutions.

Lubricating oils are formulated to include anti corrosion additives. Surface active metal passivators are included into the lubricating oil to interact with the surfaces of the metal parts and render the metal resistant to the action of corrosive materials, be they other additives or accumulated contaminants, in the lubricating oils.

Anti-rust additives (corrosion inhibitors) protect the metal surfaces by preventing attack of the metal surfaces by water or other contaminants. Some anti-rust additives are polar compounds that wet the metal surface preferentially, protecting the metal surface with a hydrocarbonaceous-type or oil-type film. Other anti-rust/anti-corrosion additives absorb water by incorporating it into a water-in-oil emulsion so that only the continuous oil phase is in contact with the metal surface. Yet other anti-rust additives chemically adhere to the metal to produce a non-reactive surface. Suitable additives include zinc dithiophosphates, metal phenolates, basic metal sulfonates, fatty acids, amines.

Other metal corrosion inhibitors include thiadiazoles, e.g., dialkyl dimercapto thiadiazoles, triazoles, e.g., benzotriazole, toluoyltriazole. Such anti-corrosion materials are commonly incorporated into oils in an amount in the range of about 0.01 to 5.0 wt %, preferably about 0.01 to 1.5 wt %, more commonly, especially in the case of the surface active corrosion inhibitors, in an amount in the range of about 0.01 to 1.0 wt %.

U.S. Pat. No. 6,180,575 discloses high performance lubricating oils. The patent, in the Background of the Invention, indicates that the properties of oils may be differentiated on the basis of whether they are bulk properties which are not affected significantly by contact with the surface of other materials, or are surface-related properties which affect and are affected by the surfaces with which the oil is in contact. Oxidation resistance of the oil, for instance, belongs largely in the former category although the rate at which an oil undergoes oxidation in use is affected by the character of the metal surfaces in contact with the oil. Extreme pressure resistance may also be included in this category. Other properties such as anti-corrosion, anti-rust, anti-wear are directly dependent on the nature of the surfaces—usually metal—with which the oil is in contact during use. The properties which are surface dependent impart another consideration into the formulation of a finished lubricant since the additives which are used to improve the properties of the lubricant base stock and provide the desired balance of properties may be in competition for available sites on the metal surface. For this reason, it is often difficult to obtain a good balance between the performance properties which are surface dependent. One instance of this is with anti-wear and anti-rust properties: it is difficult to produce an oil which possesses both properties in good measure at the same time.

Different types of base stocks have different performance characteristics. Ester base stocks, for example, the neopentylpolyol esters such as the pentaerythritol esters of monobasic carboxylic acids, have excellent high performance properties as indicated by their common use in gas turbine lubricants. They also provide excellent anti-wear characteristics when conventional anti-wear additives are present and they do not have any adverse effect on the performance of rust inhibitors. On the other hand, esters have relatively poor hydrolytic stability, undergoing hydrolysis readily in the presence of water at even moderate temperatures. They are, therefore, less well suited for use in wet applications such as paper-making machinery.

Hydrolytic stability can be improved by the use of hydrocarbon base stocks. The use of alkyl aromatics in combination with the other hydrocarbon base stocks such as hydrogenated polyalphaolefin (PAO) synthetic hydrocarbons and the improved hydrolytic stability of these combinations is described, for example, in U.S. Pat. No. 5,602,086. Traditional formulations containing PAO's, however, present other performance problems. Although the hydrolytic stability of hydrocarbon base stocks including PAO's is superior to that of the esters, it is frequently difficult to obtain a good balance of the surface-related properties such as anti-wear and anti-rust because, as noted above, these surface-related properties are dependent upon the extent to which the additives present in the base stock compete for sites on the metal surfaces which they are intended to protect and high quality hydrocarbon base stocks such as PAO's do not favorably interact with the additives used for this purpose.

U.S. Pat. No. 6,180,575 addresses this problem by presenting a lubricating oil composition having improved anti-wear and anti-rust performance characteristics which comprises a base fluid which comprises at least 50 wt % of a hydrocarbon base fluid and an additive combination comprising (a) an adduct of a substituted triazole and a hydrocarbon amine phosphate in an amount below about 5 wt % of the total composition, and, (b) a trihydrocarbyl phosphate in an amount up to 5 wt % of the total composition wherein the ratio of the trihydrocarbyl phosphate to the adduct is between about 2:1 to about 5:1. The base fluid is characterized as a hydrocarbon oil of mineral oil origin or synthetic which is of lubricating viscosity, is saturated in character with a viscosity index of 110 or greater, has a sulfur content below 0.3 wt % and a total aromatics and olefinic content below 10 wt % each. The hydrocarbon base fluid comprising at least 50 wt % of the base fluid can comprise a hydroisomerized wax of mineral oil origin or a hydroisomerized Fischer-Tropsch wax or poly alpha olefin synthetic hydrocarbon, as well as base oils of mineral oil origin in Group II and Group III and other synthetic hydrocarbon stocks including those of Group V, and preferably the poly alpha olefins. The patent does not distinguish between these different base oils and only exemplifies mixtures of PAO and alkylated naphthalene.

U.S. Pat. No. 6,080,301 is directed to premium synthetic lubricant base stocks having at least 95% non-cyclic paraffins. Such base stock is produced by the hydroisomerization of Fischer-Tropsch synthesized wax under a particular set of conditions. The patent recites that this hydroisomerized stock and lube oils formulated from them have exhibited properties superior to PAO and conventional mineral oil derived base stocks. Consequently these hydroisomerized stocks can be used as is or blended into formulations in amounts constituting 20%, 40%, 60% or more of the base stock used in the formulations and can contain various additives or additives packages. The text also indicates that additive packages can and do contain many different chemical types of additives and the performance of the hydroisomerized base stock of the patent with a particular additive or additive package cannot be predicted a priority. In the patent the superiority of the unadditized hydroisomerized Fischer-Tropsch wax base stock over PAO and mineral oil stock is only demonstrated by superior resistance of the oil per se to oxidation and nitration.

U.S. Pat. No. 6,475,960 similarly is directed to premium synthetic lubricants which are derived waxy, paraffinic Fischer-Tropsch synthesized hydrocarbon by hydroisomerizing said stock, dewaxing and fractionation. It is indicated that the isomerized stock fraction boiling in the lube oil boiling range can be used as base stock in formulation typically containing one or more additives such as detergents, dispersants, antioxidants, anti-wear additives, pour point depressant, VI improvers, corrosion inhibitors such as benzotriazole and the like. In the examples of such isomerized stock containing an additive package, the additive package contained viscosity modifier PIBSA-PAM dispersant, detergents, antioxidants, ZDDP anti wear additive, demulsifier and anti foaming agent or it contained PIBSA-PAM, PIB-SA dispersants, antiwear additives, detergent, anti-oxidant, friction modifier, demulsifier and anti-foamant. These hydroisomerized Fischer-Tropsch wax derived base stock formulations were compared against formulations based on mineral oil and PAO using the same recited additive packages. The formulations were evaluated for panel coker deposits, oxidation stability and CCS viscosity wherein the formulations based on the isomerized Fischer-Tropsch wax exhibited their superiority in regard to each of these characteristics, based on the nature of the base oils, per se.

U.S. Pat. No. 6,191,078 relates to an aviation piston engine oil containing from about 60 to 75 wt % mineral oil base stocks, from about 15 to about 40 wt % polyalpha olefin (PAO), about 3 to 6 wt % PIBSA/PAM ashless dispersant, a viscosity index improver, a corrosion inhibitor, antiwear agent, a pour point depressant, an antifoam and an antioxidant.

U.S. Pat. No. 5,858,932 discloses a lubricating oil composition for internal combustion engines that contains A) 30-98% by weight of a mineral oil having a viscosity 2-30 $mm^2/s$ at 100° C. and a viscosity index not less than 100, B) 2-70% by weight of a polyalpha olefin, zinc dithiophosphate in an amount corresponding, as reduced amount of phosphorus, to 0.02-0.15 parts by weight with respect to 100 parts by weight of the base oil.

U.S. Pat. No. 6,060,437 relates to a lubricating oil composition for internal combustion engines that comprises A) a major amount of a base stock of lubricating viscosity containing from greater than 35 to less than 70 mass % of one or more PAO's, the balance preferably being one or more Group I base stocks and B) two or more additive components such as an ashless dispersant and a metal detergent.

WO 2004/003113 patent relates to a lubricant composition comprising a mixture of at least two Fischer-Tropsch derived base oils and one or more additives wherein one Fischer-Tropsch derived base oil (low viscosity component) has a kinematic viscosity at 100° C. of less than 7 $mm^2/s$ and a second Fischer-Tropsch derived base oil (high viscosity component) has a kinematic viscosity at 100° C. of more than 18 $mm^2/s$.

US Publication 2004/0118744 relates to a lubricating base oil composition having at least 95 wt % saturates, of which saturates fraction between 10 and 30 wt % are cyclo-paraffins and the reminder being n- and iso-paraffins, having a viscosity index of above 120 and a pour point below −15° C.

According to Rudnick and Shubkin ["Poly (α-olefin)", L. R. Rudnick and R. L. Shubkin, Chapter 1, in "Synthetic Lubricants and High-Performance Functional Fluids, 2nd Edition, L. R. Rudnick and R. L. Shubkin (ed.), Marcel Dekker Inc., New York, N.Y., 1999], poly (α-olefin), or poly alpha olefin (PAO), is a hydrocarbon manufactured by the catalytic oligomerization (polymerization to low molecular weight products) of linear olefins having six or more carbon atoms. Common commercial low-viscosity grades of PAO that are useful as lubricant base stocks have kinematic viscosity at 100° C. in the range of about 2-10 $mm^2/s$, with viscosity index in the range of about 124-143.

According to R. A. Phillipps ["Highly Refined Mineral Oils", Ronald A. Phillipps, Chapter 17, in "Synthetic Lubricants and High-Performance Functional Fluids, 2nd Edition, L. R. Rudnick and R. L. Shubkin (ed.), Marcel Dekker Inc., New York, N.Y., 1999.], base oils that are produced via hydrocracking and/or hydroisomerization processes are broadly referred to as VHVI (i.e., very high viscosity index) base oils. Common examples of VHVI base stocks have kinematic viscosity at 100° C. of about 4 $mm^2/s$ and about 6 $mm^2/s$, with viscosity index in the range of 128-146. R. A. Phillipps cites Shell XHVI and Exxon Exxsyn as examples of VHVI base stocks and states: "It will be noted that Shell XHVI and Exxon Exxsyn are both virtually 100% saturates with no measurable aromatics." Further, R. A. Phillipps states "As a point of interest, VHVI base oils can be manufactured by the synthesis of natural gas to wax, using the Fischer-Tropsch process. The wax can then be processed by hydroisomerization or catalytic isomerization of the wax to produce VHVI base oils. Evaluation of these VHVI base oils shows that they exhibit excellent oxidation stability as well as the very high VI shown by the laboratory tests. Performance is comparable to that obtained by poly (α-olefins), which might be expected because of their broadly similar chemical structure, but at reduced costs of production."

GTL/wax isomerate base stocks and base oils of this invention have kinematic viscosity at 100° C. in the low-viscosity range of about 3-10 $mm^2/s$, and in the higher-viscosity range of greater than 10 $mm^2/s$, with viscosity index in the range of about 130 or greater, preferably about 135 or greater, and more preferably about 140 or greater. GTL/wax isomerate base stocks and base oils of this invention fit the definition of VHVI base oils, as cited by R. A. Phillips.

Both PAO and GTL/wax isomerate base stocks and base oils have virtually 100% saturates with nil aromatics.

Therefore, one expert opinion holds that GTL/wax isomerate base stocks and base oils would have exhibited performance comparable to that obtained by PAO base stocks and base oils.

SUMMARY OF THE INVENTION

It has been discovered that lubricating oil formulations comprising base oils comprising one or more hydrodewaxate or hydroisomerate base stock(s) and/or base oil(s), GTL base stock(s) and/or base oil(s), or mixtures thereof, preferably GTL base stock(s) and/or base oil(s) when additized with one or more anti-corrosion additives, preferably surface active metal passivators exhibit unexpected superior performance in inhibiting corrosion, preferably metal corrosion, not only initially but, more significantly, also in use, the rate at which material, preferably metal corrodes being reduced over time as compared to the rate of corrosion experienced with lubricants containing the same corrosion inducing materials or additives but employing base oils other than one or more hydrodewaxate or hydroisomerate base stock(s) and/or base oil(s), GTL base stock(s) and/or base oil(s), or mixtures thereof, preferably GTL base stock(s) and/or base oil(s).

It has also been discovered that replacing at least part of the mineral oil base oil or polyalpha olefin (PAO) base oil in apparatus lubricating oils, especially aviation piston engine lubricating oil compositions with one or more hydrodewaxate or hydroisomerate base stock(s) and/or base oil(s), GTL material derived base stock(s) and/or base oil(s), or mixtures thereof, preferably GTL base stock(s) and/or base oil(s), maintains the thermal and oxidative stability with sufficient solvency to reduce engine deposits provides good low temperature properties and improves resistance to corrosion. The viscometric properties of the lubricant oil composition are also improved. The lubricant oil composition also provides unexpectedly improved rust protection and has a low sulfur content.

The present invention is directed to a method for reducing the corrosivity, preferably metal corrosivity/improving the anti-corrosivity/enhancing the corrosion resistance, preferably metal corrosion resistance, of lubricating oils containing one or more anti-corrosion additives, preferably surface active metal passivator(s) and a base oil by using as the base oil one or more hydrodewaxate or hydroisomerate base stock(s) and/or base oil(s), GTL base stock(s) and/or base oil(s), or mixtures thereof, preferable GTL basestock(s) boiling in the lube oil boiling range.

The present invention is also directed to a method for reducing the corrosivity, preferably metal corrosivity/improving the anti-corrosivity/enhancing the corrosion resistance, preferably metal corrosion resistance, of lubricating oils containing one or more anti-corrosion additives, preferably surface active metal passivators and one or more corrosive anti-wear additive(s) and a base oil by using as the base oil one or more hydrodewaxate or hydroisomerate base stock(s) and/or base oil(s), GTL base stock(s) and/or base oil(s), or mixtures thereof, preferably GTL base stock(s) and/or base oil(s) boiling in the lube oil boiling range.

The present invention is also directed to a method for reducing the corrosivity, preferably metal corrosivity/improving the anti-corrosivity/enhancing the corrosion resistance, preferably metal corrosion resistance, of lubricating oils containing one or more anti-corrosion additives, preferably surface active metal passivators and, optionally, one or more corrosive anti-wear additives and a base oil comprising mineral oil base oil and/or polyalpha olefin base oil by replacing all or part of the mineral oil base oil and/or polyalpha olefin base oil with one or more hydrodewaxate or hydroisomerate base stock(s) and/or base oil(s), GTL base stock(s) and/or base oil(s), or mixtures thereof, preferably GTL base stock(s) and/or base oil(s) boiling in the lube oil boiling range.

The present invention is also directed to a method for reducing the rate of corrosion, preferably ferrous and/or non-ferrous metal corrosion in an apparatus lubricated using a lubricating oil formulation containing one or more surface active metal passivators during use by lubricating the apparatus using lubricating oil formulations containing one or more anti-corrosion additives, preferably surface active metal passivator and a base oil comprising one or more hydrodewaxate or hydroisomerate base stock(s) and/or base oil(s), GTL base stock(s) and/or base oil(s) or mixtures thereof, preferably GTL base stock(s) and/or base oil(s) boiling in the lubricating oil boiling range.

In another aspect the present invention is directed to a method for reducing the rate of corrosion, preferably ferrous and/or non-ferrous metal corrosion in an apparatus lubricated using a lubricating oil formulation containing one or more anti-corrosion additives, preferably surface active metal passivators and one or more corrosive anti-wear additive by lubricating the apparatus using a lubricating oil containing one or more anti-corrosion additives, preferably surface active metal passivators and one or more corrosive anti-wear additives and a base oil comprising one or more hydrodewaxate or hydroisomerate base stock(s) and/or base oil(s), GTL base stock(s) and/or base oil(s) or mixtures thereof, preferably GTL base stock(s) and/or base oil(s) boiling in the lubricating oil boiling range.

In another aspect the present invention is directed to an aviation piston engine oil comprising:

(i) a base oil comprising:

(a) at least 10 wt %, preferably at least 20 wt %, more preferably at least 30 wt %, still more preferably at least 40 wt %, most preferably at least 50 wt % based on the total weight of the base oil of one or more hydrodewaxate or hydroisomerate base stock(s) and/or base oil(s), GTL base stock(s) and/or base oil(s) and mixtures thereof, preferably GTL base stock(s) and/or base oil(s) lubricating oil base stocks boiling in the lubricating oil boiling range and having a kinematic viscosity at 100° C. in the range from about 3 to 25 $mm^2/s$, preferably about 8 to 25 $mm^2/s$, more preferably about 10 to 25

$mm^2/s$, still more preferably about 12 to 25 $mm^2/s$, even more preferably about 14 to 20 $mm^2/s$.

(b) about 20 to about 90 wt % based on the total weight of the base oil of one or more mineral oils having a kinematic viscosity at 100° C. in the range from about 4 to 40 $mm^2/s$, preferably selected from API Group I or Group II or mixture thereof, (c) about zero to about 30 wt % based on the total weight of the base oil of polyalphaolefin having a kinematic viscosity at 100° C. in the range from about 4 to 40 $mm^2/s$;

(ii) an effective amount of additives comprising one or more of viscosity index improver, anti oxidants, anti-foam agents, dyes, ashless dispersant, anti-wear additives, extreme pressure additives;

(iii) about 0.001 to about 5 wt %, preferably about 0.01 to 1.5 wt %, more preferably about 0.1 to 1.0 wt %, still more preferably about 0.2 to 0.6 wt %, even more preferably about 0.2 to 0.5 wt %, most preferably about 0.3 to 0.5 wt % active ingredient surface active metal passivator.

When the base oil (i)(a) above constitute a mixture of one or more hydrodewaxate or hydroisomerate base stock(s) and/or base oil(s) and/or GTL base stock(s) and/or base oil(s), at least one of the base stocks and/or base oils of said mixture preferably has a KV @ 100° C. of about 10 to 25 $mm^2/s$, preferably about 12 to 25 $mm^2/s$, more preferably about 14 to 20 $mm^2/s$, the heavier base stock and/or base oil generally constituting about 20 to 80 wt %, preferably about 40 to 60 wt %, more preferably about 45 to 55 wt % of the mixture of (i)(a).

In yet another aspect the present invention is directed to a method for inhibiting the corrosivity, preferably ferrous and/or non-ferrous metal corrosivity of an aviation piston engine lubricating oil comprising a base oil additized with at least 2 wt % of an ashless dispersant, an effective amount of ashless additives comprising one or more of viscosity index improver, anti-oxidants, anti-foaming agents, dyes, anti-wear additive, extreme pressure additive, surface active metal passivators by employing as the base oil in the aviation piston engine lubricating oil at least 10 wt %, preferably at least 30 wt %, more preferably at least 50 wt % (all weight percent being based on the total weight of the base oil) of one or more hydrodewaxate or hydroisomerate base stock(s) and/or base oil(s), GTL base stock(s) and/or base oil(s), or mixtures thereof, preferably GTL base stock(s) and/or base oil(s) lubricating oil base stocks boiling in the lubricating oil boiling range and having a kinematic viscosity at 100° C. in the range of from about 4 to about 25 $mm^2/sec$, preferably about 8 to 25 $mm^2/sec$, more preferably about 10 to 25 $mm^2/sec$, still more preferably about 12 to 25 $mm^2/sec$, even more preferably about 14 to 20 $mm^2/sec$ derived from GTL material, about 20 to about 90 wt % of one or more mineral oils having a viscosity at 100° C. in the range from about 4 to about 40 $mm^2/sec$ and about zero to about 30 wt % polyalphaolefin having a kinematic viscosity at 100° C. in the range from about 4 to about 40 $mm^2/sec$.

In the present invention the anti-corrosion additives, preferably surface active metal passivator is present in an amount in the range of about 0.001 to about 5 wt %, preferably about 0.01 to 1.5 wt %, more preferably about 0.1 to about 1.0 wt %, still more preferably about 0.2 to about 0.6 wt %, even more preferably about 0.2 to 0.5 wt %, most preferably about 0.3 to 0.5 wt % active ingredient. When present in combination with corrosive anti-wear additives the anti-wear additive and the anti-corrosion additives, preferably surface active metal passivator/anti-corrosion additive is employed at an anti-wear additive, anti-corrosion additive weight ratio of about 45:1 to 1:1, preferably about 30:1 to 1:1, more preferably 15.1 to 1:1, still more preferably about 15:1 to 3:1, even more preferably about 15:2 to 3:1.

As previously indicated, the base oil necessarily utilized in the present invention contains one or more non-conventional or unconventional base stock(s) and/or base oil(s) identified as hydrodewaxate or hydroisomerate base stock(s) and/or base oil(s), GTL base stock(s) and/or base oil(s), or mixtures thereof, preferably GTL base stock(s) and/or base oil(s).

The non-conventional or unconventional base stocks and/or base oils constitute one or more of a mixture of base stock(s) and/or base oils derived from one or more Gas-to-Liquids (GTL) materials, as well as hydrodewaxed, or hydroisomerized/conventional cat (or solvent) dewaxed base stock(s) and/or base oil(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

As used herein, the following terms have the indicated meanings:

a) "wax"—hydrocarbonaceous material having a high pour point, typically existing as a solid at room temperature, i.e., at a temperature in the range from about 15° C. to 25° C., and consisting predominantly of paraffinic materials;

b) "paraffinic" material: any saturated hydrocarbons, such as alkanes. Paraffinic materials may include linear alkanes, branched alkanes (iso-paraffins), cycloalkanes (cycloparaffins; mono-ring and/or multi-ring), and branched cycloalkanes;

c) "hydroprocessing": a refining process in which a feedstock is heated with hydrogen at high temperature and under pressure, commonly in the presence of a catalyst, to remove and/or convert less desirable components and to produce an improved product;

d) "hydrotreating": a catalytic hydrogenation process that converts sulfur- and/or nitrogen-containing hydrocarbons into hydrocarbon products with reduced sulfur and/or nitrogen content, and which generates hydrogen sulfide and/or ammonia (respectively) as byproducts; similarly, oxygen containing hydrocarbons can also be reduced to hydrocarbons and water;

e) "catalytic dewaxing": a conventional catalytic process in which normal paraffins (wax) and/or waxy hydrocarbons, e.g., slightly branched iso-paraffins, are converted by cracking/fragmentation into lower molecular weight species to insure that the final oil product (base stock or base oil) has the desired product pour point;

f) "hydroisomerization" (or isomerization): a catalytic process in which normal paraffins (wax) and/or slightly branched iso-paraffins are converted by rearrangement/isomerization into branched or more branched iso-paraffins (the isomerate from such a process possibly requiring a subsequent additional wax removal step to ensure that the final oil product (base stock or base oil) has the desired product pour point);

g) "hydrocracking": a catalytic process in which hydrogenation accompanies the cracking/fragmentation of hydrocarbons, e.g., converting heavier hydrocarbons into lighter hydrocarbons, or converting aromatics and/or cycloparaffins (naphthenes) into non-cyclic branched paraffins.

h) "hydrodewaxing": (e.g., ISODEWAXING® of Chevron or MSDW™ of Exxon Mobil corporation) a very selective catalytic process which in a single step or by use of a single catalyst or catalyst mixture effects conversion of wax by isomerization/rearrangement of the n-paraffins and slightly branched isoparaffins into more heavily branched isoparaffins, the resulting product not requiring a separate conventional catalytic or solvent dewaxing step to meet the desired product pour point;

i) the terms "hydroisomerate", "isomerate", "catalytic dewaxate", and "hydrodewaxate" refer to the products produced by the respective processes, unless otherwise specifically indicated.

Thus the term "hydroisomerization/cat dewaxing" is used to refer to catalytic processes which have the combined effect of converting normal paraffins and/or waxy hydrocarbons by rearrangement/isomerization, into more branched iso-paraffins, followed by (1) catalytic dewaxing to reduce the amount of any residual n-paraffins or slightly branched iso-paraffins present in the isomerate by cracking/fragmentation or by (2) hydrodewaxing to effect further isomerization and very selective catalytic dewaxing of the isomerate, to reduce the product pour point. When the term (or solvent), is included in the recitation, the process described involves hydroisomerization followed by solvent dewaxing which effects the physical separation of wax from the hydroisomerate so as to reduce the product pour point.

GTL materials are materials that are derived via one or more synthesis, combination, transformation, rearrangement, and/or degradation/deconstructive processes from gaseous carbon-containing compounds, hydrogen-containing compounds, and/or elements as feedstocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons, for example waxy synthesized hydrocarbons, that are themselves derived from simpler gaseous carbon-containing compounds, hydrogen-containing compounds and/or elements as feedstocks. GTL base stock(s) and/or base oils include oils boiling in the lube oil boiling range separated/fractionated from synthesized GTL materials such as for example, by distillation and subsequently subjected to a final wax processing step which is either the well-known catalytic dewaxing process, or solvent dewaxing process, to produce lube oils of reduced/low pour point; synthesized wax isomerates, comprising, for example, hydrodewaxed, or hydroisomerized/cat (or solvent) dewaxed synthesized hydrocarbons; hydrodewaxed, or hydroisomerized/cat (or solvent) dewaxed Fischer-Tropsch (F-T) material (i.e., hydrocarbons, waxy hydrocarbons, waxes and possible analogous oxygenates); preferably hydrodewaxed, or hydroisomerized/cat (or solvent) dewaxed F-T hydrocarbons, or hydrodewaxed or hydroisomerized/cat (or solvent) dewaxed, F-T waxes, hydrodewaxed, or hydroisomerized/cat (or solvent) dewaxed synthesized waxes, or mixtures thereof.

GTL base stock(s) and/or base oils derived from GTL materials, especially, hydrodewaxed, or hydroisomerized/cat (or solvent) dewaxed F-T material derived base stock(s), and other hydrodewaxed, or hydroisomerized/cat (or solvent) dewaxed wax derived base stock(s) are characterized typically as having kinematic viscosities at 100° C. of from about 2 $mm^2/s$ to about 50 $mm^2/s$, preferably from about 3 $mm^2/s$ to about 50 $mm^2/s$, more preferably from about 3.5 $mm^2/s$ to about 30 $mm^2/s$, as exemplified by a GTL base stock derived by the isodewaxing of F-T wax, which has a kinematic viscosity of about 4 $mm^2/s$ at 100° C. and a viscosity index of about 130 or greater. Preferably the wax treatment process is hydrodewaxing carried out in a process using a single hydrodewaxing catalyst. Reference herein to Kinematic viscosity refers to a measurement made by ASTM method D445.

GTL base stocks and/or base oils derived from GTL materials, especially hydrodewaxed, or hydroisomerized/cat (or solvent) dewaxed F-T material derived base stock(s) and/or base oil(s), and other hydrodewaxed, or hydroisomerized/cat (or solvent) dewaxed wax-derived base stock(s) and/or base oil(s), which can be used as base stock components of this invention are further characterized typically as having pour points of about −5° C. or lower, preferably about −10° C. or lower, more preferably about −15° C. or lower, still more preferably about −20° C. or lower, and under some conditions may have advantageous pour points of about −25° C. or lower, with useful pour points of about −30° C. to about −40° C. or lower. If necessary, a separate dewaxing step may be practiced to achieve the desired pour point. In the present invention, however, the GTL or other hydrodewaxed, or hydroisomerized/cat (or solvent) dewaxed wax-derived base stock(s) and/or base oil(s) used are those having pour points of about −30° C. or higher, preferably about −25° C. or higher, more preferably about −20° C. or higher. References herein to pour point refer to measurement made by ASTM D97 and similar automated versions.

The GTL base stock(s) and/or base oil(s) derived from GTL materials, especially hydrodewaxed or hydroisomerized/cat (or solvent) dewaxed F-T material derived base stock(s) and/or base oil(s), and other such wax-derived base stock(s) and/or base oil(s) which are base stock components which can be used in this invention are also characterized typically as having viscosity indices of 80 or greater, preferably 100 or greater, and more preferably 120 or greater. Additionally, in certain particular instances, the viscosity index of these base stocks and/or base oils may be preferably 130 or greater, more preferably 135 or greater, and even more preferably 140 or greater. For example, GTL base stock(s) that derive from GTL materials preferably F-T materials especially F-T wax generally have a viscosity index of 130 or greater. References herein to viscosity index refer to ASTM method D2270.

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stocks and/or base oils typically have very low sulfur and nitrogen content, generally containing less than about 10 ppm, and more typically less than about 5 ppm of each of these elements. The sulfur and nitrogen content of GTL base stock and/or base oil obtained by the hydroisomerization/isodewaxing of F-T material, especially F-T wax is essentially nil.

In a preferred embodiment, the GTL base stock(s) and/or base oil(s) comprise(s) paraffinic materials that consist predominantly of non-cyclic isoparaffins and only minor amounts of cycloparaffins. These GTL base stock(s) and/or base oil(s) typically comprise paraffinic materials that consist of greater than 60 wt % non-cyclic isoparaffins, preferably greater than 80 wt % non-cyclic isoparaffins, more preferably greater than 85 wt % non-cyclic isoparaffins, and most preferably greater than 90 wt % non-cyclic isoparaffins.

Useful compositions of GTL base stock(s) and/or base oil(s), hydrodewaxed or hydroisomerized/cat (or solvent) dewaxed F-T material derived base stock(s) and/or base oil(s), and wax-derived hydrodewaxed, or hydroisomerized/cat (or solvent) dewaxed base stock(s) and/or base oil(s), such as wax isomerates or hydrodewaxates, are recited in U.S. Pat. Nos. 6,080,301; 6,090,989, and 6,165,949 for example.

Such base stock(s) and/or base oil(s), derived from waxy feeds, which are also suitable for use in this invention, are paraffinic fluids of lubricating viscosity derived from hydrodewaxed, or hydroisomerized/cat (or solvent) dewaxed waxy feedstocks of mineral oil, non-mineral oil, non-petroleum, or natural source origin, e.g., feedstocks such as one or more of gas oils, slack wax, waxy fuels hydrocracker bottoms, hydrocarbon raffinates, natural waxes, hyrocrackates, thermal crackates, foots oil, wax from coal liquefaction or from shale oil, or other suitable mineral oil, non-mineral oil, non-petroleum, or natural source derived waxy materials, linear or branched hydrocarbyl compounds with carbon number of about 20 or greater, preferably about 30 or greater, and mixtures of such isomerate/isodewaxate base stocks and/or base oils.

Slack wax is the wax recovered from any waxy hydrocarbon oil including synthetic oil such as F-T waxy oil or petroleum oils by solvent or autorefrigerative dewaxing. Solvent dewaxing employs chilled solvent such as methyl ethyl ketone (MEK), methyl isobutyl ketone (MIBK), mixtures of MEK/MIBK, mixtures of MEK and toluene, while autorefrigerative dewaxing employs pressurized, liquefied low boiling hydrocarbons such as propane or butane.

Slack wax(es) secured from synthetic waxy oils such as F-T waxy oil will usually have zero or nil sulfur and/or nitrogen containing compound content. Slack wax(es) secured from petroleum oils, may contain sulfur and nitrogen containing compounds. Such heteroatom compounds must be removed by hydrotreating (and not hydrocracking), as for example by hydrodesulfurization (HDS) and hydrodenitrogenation (HDN) so as to avoid subsequent poisoning/deactivation of the hydroisomerization catalyst.

The term GTL base stock and/or base oil and/or wax isomerate base stock and/or base oil as used herein and in the claims is to be understood as embracing individual fractions of GTL base stock and/or base oil and/or of wax-derived hydrodewaxed or hydroisomerized/cat (or solvent) dewaxed base stock and/or base oil as recovered in the production process, mixtures of two or more GTL base stocks and/or base oil fractions and/or wax-derived hydrodewaxed, or hydroisomerized/cat (or solvent) dewaxed base stocks/base oil fractions, as well as mixtures of one or two or more low viscosity GTL base stock(s) and/or base oil(s) fraction(s) and/or wax-derived hydrodewaxed, or hydroisomerized/cat (or solvent) dewaxed base stock(s) and/or base oil(s) fraction(s) with one, two or more higher viscosity GTL base stock(s) and/or base oil fraction(s) and/or wax-derived hydrodewaxed, or hydroisomerized/cat (or solvent) dewaxed base stock(s) and/or base oil fraction(s) to produce a dumbbell blend wherein the blend exhibits a kinematic viscosity within the aforesaid recited range.

In a preferred embodiment, the GTL material, from which the GTL base stock(s) and/or base oil(s) is/are derived is an F-T material (i.e., hydrocarbons, waxy hydrocarbons, wax). A slurry F-T synthesis process may be beneficially used for synthesizing the feed from CO and hydrogen and particularly one employing an F-T catalyst comprising a catalytic cobalt component to provide a high Schultz-Flory kinetic alpha for producing the more desirable higher molecular weight paraffins. This process is also well known to those skilled in the art.

In an F-T synthesis process, a synthesis gas comprising a mixture of $H_2$ and CO is catalytically converted into hydrocarbons and preferably liquid hydrocarbons. The mole ratio of the hydrogen to the carbon monoxide may broadly range from about 0.5 to 4, but is more typically within the range of from about 0.7 to 2.75 and preferably from about 0.7 to 2.5. As is well known, F-T synthesis processes include processes in which the catalyst is in the form of a fixed bed, a fluidized bed or as a slurry of catalyst particles in a hydrocarbon slurry liquid. The stoichiometric mole ratio for a F-T synthesis reaction is 2.0, but there are many reasons for using other than a stoichiometric ratio as those skilled in the art know. In cobalt slurry hydrocarbon synthesis process the feed mole ratio of the $H_2$ to CO is typically about 2.1/1. The synthesis gas comprising a mixture of $H_2$ and CO is bubbled up into the bottom of the slurry and reacts in the presence of the particulate F-T synthesis catalyst in the slurry liquid at conditions effective to form hydrocarbons, a portion of which are liquid at the reaction conditions and which comprise the hydrocarbon slurry liquid. The synthesized hydrocarbon liquid is separated from the catalyst particles as filtrate by means such as filtration, although other separation means such as centrifugation can be used. Some of the synthesized hydrocarbons pass out the top of the hydrocarbon synthesis reactor as vapor, along with unreacted synthesis gas and other gaseous reaction products. Some of these overhead hydrocarbon vapors are typically condensed to liquid and combined with the hydrocarbon liquid filtrate. Thus, the initial boiling point of the filtrate may vary depending on whether or not some of the condensed hydrocarbon vapors have been combined with it. Slurry hydrocarbon synthesis process conditions vary somewhat depending on the catalyst and desired products. Typical conditions effective to form hydrocarbons comprising mostly $C_{5+}$ paraffins, (e.g., $C_{5+}$-$C_{200}$) and preferably $C_{10+}$ paraffins, in a slurry hydrocarbon synthesis process employing a catalyst comprising a supported cobalt component include, for example, temperatures, pressures and hourly gas space velocities in the range of from about 320-850° F., 80-600 psi and 100-40,000 V/hr/V, expressed as standard volumes of the gaseous CO and $H_2$ mixture (0° C., 1 atm) per hour per volume of catalyst, respectively. The term "$C_{5+}$" is used herein to refer to hydrocarbons with a carbon number of greater than 4, but does not imply that material with carbon number 5 has to be present. Similarly other ranges quoted for carbon number do not imply that hydrocarbons having the limit values of the carbon number range have to be present, or that every carbon number in the quoted range is present. It is preferred that the hydrocarbon synthesis reaction be conducted under conditions in which limited or no water gas shift reaction occurs and more preferably with no water gas shift reaction occurring during the hydrocarbon synthesis. It is also preferred to conduct the reaction under conditions to achieve an alpha of at least 0.85, preferably at least 0.9 and more preferably at least 0.92, so as to synthesize more of the more desirable higher molecular weight hydrocarbons. This has been achieved in a slurry process using a catalyst containing a catalytic cobalt component. Those skilled in the art know that by alpha is meant the Schultz-Flory kinetic alpha. While suitable F-T reaction types of catalyst comprise, for example, one or more Group VIII catalytic metals such as Fe, Ni, Co, Ru and Re, it is preferred that the catalyst comprise a cobalt catalytic component. In one embodiment the catalyst comprises catalytically effective amounts of Co and one or more of Re, Ru, Fe, Ni, Th, Zr, Hf, U, Mg and La on a suitable inorganic support material, preferably one which comprises one or more refractory metal oxides. Preferred supports for Co containing catalysts comprise Titania, particularly. Useful catalysts and their preparation are known and illustrative, but nonlimiting examples may be found, for example, in U.S. Pat. Nos. 4,568,663; 4,663,305; 4,542,122; 4,621,072 and 5,545,674.

As set forth above, the waxy feed from which the base stock(s) and/or base oil(s) is/are derived is a wax or waxy feed from mineral oil, non-mineral oil, non-petroleum, or other natural source, especially slack wax, or GTL material, preferably F-T material, referred to as F-T wax. F-T wax preferably has an initial boiling point in the range of from 650-750° F. and preferably continuously boils up to an end point of at least 1050° F. A narrower cut waxy feed may also be used during the hydroisomerization. A portion of the n-paraffin waxy feed is converted to lower boiling isoparaffinic material. Hence, there must be sufficient heavy n-paraffin material to yield an isoparaffin containing isomerate boiling in the lube oil range. If catalytic dewaxing is also practiced after isomerization/isodewaxing, some of the isomerate/isodewaxate will also be hydrocracked to lower boiling material during the conventional catalytic dewaxing. Hence, it is preferred that the end boiling point of the waxy feed be above 1050° F. (1050° F.+).

When a boiling range is quoted herein it defines the lower and/or upper distillation temperature used to separate the fraction. Unless specifically stated (for example, by specifying that the fraction boils continuously or constitutes the entire range) the specification of a boiling range does not require any material at the specified limit has to be present, rather it excludes material boiling outside that range.

The waxy feed preferably comprises the entire 650-750° F.+ fraction formed by the hydrocarbon synthesis process, having an initial cut point between 650° F. and 750° F. determined by the practitioner and an end point, preferably above 1050° F., determined by the catalyst and process variables employed by the practitioner for the synthesis. Such fractions are referred to herein as "650-750° F.+ fractions". By contrast, "650-750° F.⁻ fractions" refers to a fraction with an unspecified initial cut point and an end point somewhere between 650° F. and 750° F. Waxy feeds may be processed as the entire fraction or as subsets of the entire fraction prepared by distillation or other separation techniques. The waxy feed also typically comprises more than 90%, generally more than 95% and preferably more than 98 wt % paraffinic hydrocarbons, most of which are normal paraffins. It has negligible amounts of sulfur and nitrogen compounds (e.g., less than 1 wppm of each), with less than 2,000 wppm, preferably less than 1,000 wppm and more preferably less than 500 wppm of oxygen, in the form of oxygenates. Waxy feeds having these properties and useful in the process of the invention have been made using a slurry F-T process with a catalyst having a catalytic cobalt component, as previously indicated.

The process of making the lubricant oil base stocks from waxy stocks, e.g., slack wax or F-T wax, may be characterized as an isomerization process. If slack waxes are used as the feed, they may need to be subjected to a preliminary hydrotreating step under conditions already well known to those skilled in the art to reduce (to levels that would effectively avoid catalyst poisoning or deactivation) or to remove sulfur- and nitrogen-containing compounds which would otherwise deactivate the hydroisomerization or hydrodewaxing catalyst used in subsequent steps. If F-T waxes are used, such preliminary treatment is not required because, as indicated above, such waxes have only trace amounts (less than about 10 ppm, or more typically less than about 5 ppm to nil) of sulfur or nitrogen compound content. However, some hydrodewaxing catalyst fed F-T waxes may benefit from prehydrotreatment for the removal of oxygenates while others may benefit from oxygenates treatment. The hydroisomerization or hydrodewaxing process may be conducted over a combination of catalysts, or over a single catalyst. Conversion temperatures range from about 150° C. to about 500° C. at pressures ranging from about 500 to 20,000 kPa. This process may be operated in the presence of hydrogen, and hydrogen partial pressures range from about 600 to 6000 kPa. The ratio of hydrogen to the hydrocarbon feedstock (hydrogen circulation rate) typically range from about 10 to 3500 n.l.l.$^{-1}$ (56 to 19,660 SCF/bbl) and the space velocity of the feedstock typically ranges from about 0.1 to 20 LHSV, preferably 0.1 to 10 LHSV.

Following any needed hydrodenitrogenation or hydrodesulfurization, the hydroprocessing used for the production of base stocks from such waxy feeds may use an amorphous hydrocracking/hydroisomerization catalyst, such as a lube hydrocracking (LHDC) catalysts, for example catalysts containing Co, Mo, Ni, W, Mo, etc., on oxide supports, e.g., alumina, silica, silica/alumina, or a crystalline hydrocracking/hydroisomerization catalyst, preferably a zeolitic catalyst.

Other isomerization catalysts and processes for hydrocracking, hydro-dewaxing, or hydroisomerizing GTL materials and/or waxy materials to base stock and/or or base oil are described, for example, in U.S. Pat. Nos. 2,817,693; 4,900,407; 4,937,399; 4,975,177; 4,921,594; 5,200,382; 5,516,740; 5,182,248; 5,290,426; 5,580,442; 5,976,351; 5,935,417; 5,885,438; 5,965,475; 6,190,532; 6,375,830; 6,332,974; 6,103,099; 6,025,305; 6,080,301; 6,096,940; 6,620,312; 6,676,827; 6,383,366; 6,475,960; 5,059,299; 5,977,425; 5,935,416; 4,923,588; 5,158,671; and 4,897,178; EP 0324528 (B1), EP 0532116 (B1), EP 0532118 (B1), EP 0537815 (B1), EP 0583836 (B2), EP 0666894 (B2), EP 0668342 (B1), EP 0776959 (A3), WO 97/031693 (A1), WO 02/064710 (A2), WO 02/064711 (A1), WO 02/070627 (A2), WO 02/070629 (A1), WO 03/033320 (A1) as well as in British Patents 1,429,494; 1,350,257; 1,440,230; 1,390,359; WO 99/45085 and WO 99/20720. Particularly favorable processes are described in European Patent Applications 464546 and 464547. Processes using F-T wax feeds are described in U.S. Pat. Nos. 4,594,172; 4,943,672; 6,046,940; 6,475,960; 6,103,099; 6,332,974; and 6,375,830.

Hydrocarbon conversion catalysts useful in the conversion of the n-paraffin waxy feedstocks disclosed herein to form the isoparaffinic hydrocarbon base oil are zeolite catalysts, such as ZSM-5, ZSM-11, ZSM-23, ZSM-35, ZSM-12, ZSM-38, ZSM-48, offretite, ferrierite, zeolite beta, zeolite theta, and zeolite alpha, as disclosed in U.S. Pat. No. 4,906,350. These catalysts are used in combination with Group VIII metals, in particular palladium or platinum. The Group VIII metals may be incorporated into the zeolite catalysts by conventional techniques, such as ion exchange.

In one embodiment, conversion of the waxy feedstock may be conducted over a combination of Pt/zeolite beta and Pt/ZSM-23 catalysts in the presence of hydrogen. In another embodiment, the process of producing the lubricant oil base stocks comprises hydroisomerization and dewaxing over a single catalyst, such as Pt/ZSM-35. In yet another embodiment, the waxy feed can be fed over the hydrodewaxing catalyst comprising Group VIII metal loaded ZSM-48, preferably Group VIII noble metal loaded ZSM-48, more preferably Pt/ZSM-48 in either one stage or two stages. In any case, useful hydrocarbon base oil products may be obtained. Catalyst ZSM-48 is described in U.S. Pat. No. 5,075,269. The use of the Group VIII metal loaded ZSM-48 family of catalysts, preferably platinum on ZSM-48, in the hydroisomerization of the waxy feedstock eliminates the need for any subsequent, separate dewaxing step, and is preferred.

A dewaxing step, when needed, may be accomplished using one or more of solvent dewaxing, catalytic dewaxing or hydrodewaxing processes and either the entire hydroisomerate or the 650-750° F.+ fraction may be dewaxed, depending on the intended use of the 650-750° F.− material present, if it has not been separated from the higher boiling material prior to the dewaxing. In solvent dewaxing, the hydroisomerate may be contacted with chilled solvents such as acetone, methyl ethyl ketone (MEK), methyl isobutyl ketone (MIBK), mixtures of MEK/MIBK, or mixtures of MEK/toluene and the like, and further chilled to precipitate out the higher pour point material as a waxy solid which is then separated from the solvent-containing lube oil fraction which is the raffinate. The raffinate is typically further chilled in scraped surface chillers to remove more wax solids. Autorefrigerative dewaxing using low molecular weight hydrocarbons, such as propane, can also be used in which the hydroisomerate is mixed with, e.g., liquid propane, a least a portion of which is flashed off to chill down the hydroisomerate to precipitate out the wax. The wax is separated from the raffinate by filtration, membrane separation or centrifugation. The solvent is then stripped out of the raffinate, which is then fractionated to produce the preferred base stocks useful in the present invention. Also well known is catalytic dewaxing, in which the hydroisomerate is reacted with hydrogen in the presence of a suitable dewaxing catalyst at conditions effective to lower the pour point of the hydroisomerate. Catalytic dewaxing also converts a portion of the hydroisomerate to lower boiling materials, in the boiling range, for example, 650-750° F.−, which are separated from the heavier 650-750° F.+ base stock fraction and the base stock fraction fractionated into two or more base stocks. Separation of the lower boiling material may be accomplished either prior to or during fractionation of the 650-750° F.+ material into the desired base stocks.

Any dewaxing catalyst which will reduce the pour point of the hydroisomerate and preferably those which provide a large yield of lube oil base stock from the hydroisomerate may be used. These include shape selective molecular sieves which, when combined with at least one catalytic metal component, have been demonstrated as useful for dewaxing petroleum oil fractions and include, for example, ferrierite, mordenite, ZSM-5, ZSM-11, ZSM-23, ZSM-35, ZSM-22 also known as theta one or TON, and the silicoaluminophosphates known as SAPO's. A dewaxing catalyst which has been found to be unexpectedly particularly effective comprises a noble metal, preferably Pt, composited with H-mordenite. The dewaxing may be accomplished with the catalyst in a fixed, fluid or slurry bed. Typical dewaxing conditions include a temperature in the range of from about 400-600° F., a pressure of 500-900 psig, $H_2$ treat rate of 1500-3500 SCF/B for flow-through reactors and LHSV of 0.1-10, preferably 0.2-2.0. The dewaxing is typically conducted to convert no more than 40 wt % and preferably no more than 30 wt % of the hydroisomerate having an initial boiling point in the range of 650-750° F. to material boiling below its initial boiling point.

GTL base stock(s) and/or base oil(s), hydrodewaxed, or hydroisomerized/cat (or solvent) dewaxed wax-derived base stock(s) and/or base oil(s), have a beneficial kinematic viscosity advantage over conventional API Group II and Group III base stocks, and so may be very advantageously used with the instant invention. Such GTL base stocks and/or base oils can have significantly higher kinematic viscosities, up to about 20-50 $mm^2/s$ at 100° C., whereas by comparison commercial Group II base oils can have kinematic viscosities, up to about 15 $mm^2/s$ at 100° C., and commercial Group III base oils can have kinematic viscosities, up to about 10 $mm^2/s$ at 100° C. The higher kinematic viscosity range of GTL base stocks and/or base oils, compared to the more limited kinematic viscosity range of Group II and Group III base stocks and base oils, in combination with the instant invention can provide additional beneficial advantages in formulating lubricant compositions.

The preferred base stocks and/or base oils derived from GTL materials and/or from waxy feeds are characterized as having predominantly paraffinic compositions and are further characterized as having high saturates levels, low-to-nil sulfur, low-to-nil nitrogen, low-to-nil aromatics, and are essentially water-white in color.

A preferred GTL liquid hydrocarbon composition is one comprising paraffinic hydrocarbon components in which the extent of branching, as measured by the percentage of methyl hydrogens (BI), and the proximity of branching, as measured by the percentage of recurring methylene carbons which are four or more carbons removed from an end group or branch ($CH_2 \geq 4$), are such that: (a) BI-0.5 ($CH_2 \geq 4$)>15; and (b) BI+0.85 ($CH_2 \geq 4$)<45 as measured over said liquid hydrocarbon composition as a whole.

The preferred GTL base stock and/or base oil can be further characterized, if necessary, as having less than 0.1 wt % aromatic hydrocarbons, less than 20 wppm nitrogen containing compounds, less than 20 wppm sulfur containing compounds, a pour point of less than −18° C., preferably less than −30° C., a preferred BI≥25.4 and ($CH_2 \geq 4$)≤22.5. They have a nominal boiling point of 370° C.$^+$, on average they average fewer than 10 hexyl or longer branches per 100 carbon atoms and on average have more than 16 methyl branches per 100 carbon atoms. They also can be characterized by a combination of dynamic viscosity, as measured by CCS at −40° C., and kinematic viscosity, as measured at 100° C. represented by the formula: DV (at −40° C.)<2900 (KV at 100° C.)−7000.

The preferred GTL base stock and/or base oil is also characterized as comprising a mixture of branched paraffins characterized in that the GTL lubricant base stock and/or base oil contains at least 90% of a mixture of branched paraffins, wherein said branched paraffins are paraffins having a carbon chain length of about $C_{20}$ to about $C_{40}$, a molecular weight of about 280 to about 562, a boiling range of about 650° F. to about 1050° F., and wherein said branched paraffins contain up to four alkyl branches and wherein the free carbon index of said branched paraffins is at least about 3.

In the above the Branching Index (BI), Branching Proximity ($CH_2 \geq 4$), and Free Carbon Index (FCI) are determined as follows:

Branching Index

A 359.88 MHz 1H solution NMR spectrum is obtained on a Bruker 360 MHz AMX spectrometer using 10% solutions in $CDCl_3$. TMS is the internal chemical shift reference. $CDCl_3$ solvent gives a peak located at 7.28. All spectra are obtained under quantitative conditions using 90 degree pulse (10.9 μs), a pulse delay time of 30 s, which is at least five times the longest hydrogen spin-lattice relaxation time ($T_1$), and 120 scans to ensure good signal-to-noise ratios.

H atom types are defined according to the following regions:

- 9.2-6.2 ppm hydrogens on aromatic rings;
- 6.2-4.0 ppm hydrogens on olefinic carbon atoms;
- 4.0-2.1 ppm benzylic hydrogens at the α-position to aromatic rings;
- 2.1-1.4 ppm paraffinic CH methine hydrogens;
- 1.4-1.05 ppm paraffinic $CH_2$ methylene hydrogens;
- 1.05-0.5 ppm paraffinic $CH_3$ methyl hydrogens.

The branching index (BI) is calculated as the ratio in percent of non-benzylic methyl hydrogens in the range of 0.5 to 1.05 ppm, to the total non-benzylic aliphatic hydrogens in the range of 0.5 to 2.1 ppm.

Branching Proximity ($CH_2 \geq 4$)

A 90.5 MHz$^3$CMR single pulse and 135 Distortionless Enhancement by Polarization Transfer (DEPT) NMR spectra are obtained on a Brucker 360 MHzAMX spectrometer using 10% solutions in $CDCL_3$. TMS is the internal chemical shift reference. $CDCL_3$ solvent gives a triplet located at 77.23 ppm in the $^{13}C$ spectrum. All single pulse spectra are obtained under quantitative conditions using 45 degree pulses (6.3 μs), a pulse delay time of 60 s, which is at least five times the longest carbon spin-lattice relaxation time ($T_1$), to ensure complete relaxation of the sample, 200 scans to ensure good signal-to-noise ratios, and WALTZ-16 proton decoupling.

The C atom types $CH_3$, $CH_2$, and CH are identified from the 135 DEPT $^{13}C$ NMR experiment. A major $CH_2$ resonance in all $^{13}C$ NMR spectra at ≈29.8 ppm is due to equivalent recurring methylene carbons which are four or more removed from an end group or branch (CH2>4). The types of branches are determined based primarily on the $^{13}C$ chemical shifts for the methyl carbon at the end of the branch or the methylene carbon one removed from the methyl on the branch.

Free Carbon Index (FCI). The FCI is expressed in units of carbons, and is a measure of the number of carbons in an isoparaffin that are located at least 5 carbons from a terminal carbon and 4 carbons way from a side chain. Counting the terminal methyl or branch carbon as "one" the carbons in the FCI are the fifth or greater carbons from either a straight chain terminal methyl or from a branch methane carbon. These carbons appear between 29.9 ppm and 29.6 ppm in the carbon-13 spectrum. They are measured as follows:

a) calculate the average carbon number of the molecules in the sample which is accomplished with sufficient accuracy for lubricating oil materials by simply dividing the molecular weight of the sample oil by 14 (the formula weight of $CH_2$);
b) divide the total carbon-13 integral area (chart divisions or area counts) by the average carbon number from step a. to obtain the integral area per carbon in the sample;
c) measure the area between 29.9 ppm and 29.6 ppm in the sample; and
d) divide by the integral area per carbon from step b. to obtain FCI.

Branching measurements can be performed using any Fourier Trans-form NMR spectrometer. Preferably, the measurements are performed using a spectrometer having a magnet of 7.0 T or greater. In all cases, after verification by Mass Spectrometry, UV or an NMR survey that aromatic carbons were absent, the spectral width was limited to the saturated carbon region, about 0-80 ppm vs. TMS (tetramethylsilane). Solutions of 15-25 percent by weight in chloroform-dl were excited by 45 degrees pulses followed by a 0.8 sec acquisition time. In order to minimize non-uniform intensity data, the proton decoupler was gated off during a 10 sec delay prior to the excitation pulse and on during acquisition. Total experiment times ranged from 11-80 minutes. The DEPT and APT sequences were carried out according to literature descriptions with minor deviations described in the Varian or Bruker operating manuals.

DEPT is Distortionless Enhancement by Polarization Transfer. DEPT does not show quaternaries. The DEPT 45 sequence gives a signal for all carbons bonded to protons. DEPT 90 shows CH carbons only. DEPT 135 shows CH and $CH_3$ up and $CH_2$ 180 degrees out of phase (down). APT is Attached Proton Test. It allows all carbons to be seen, but if CH and $CH_3$ are up, then quaternaries and $CH_2$ are down. The sequences are useful in that every branch methyl should have a corresponding CH and the methyls are clearly identified by chemical shift and phase. The branching properties of each sample are determined by C-13 NMR using the assumption in the calculations that the entire sample is isoparaffinic. Corrections are not made for n-paraffins or cyclo-paraffins, which may be present in the oil samples in varying amounts. The cycloparaffins content is measured using Field Ionization Mass Spectroscopy (FIMS).

GTL base stock(s) and/or base oil(s), and hydrodewaxed, or hydroisomerized/cat (or solvent) dewaxed wax base stock(s) and/or base oil(s), for example, hydroisomerized or hydrodewaxed waxy synthesized hydrocarbon, e.g., Fischer-Tropsch waxy hydrocarbon base stock(s) and/or base oil(s) are of low or zero sulfur and phosphorus content. There is a movement among original equipment manufacturers and oil formulators to produce formulated oils of ever increasingly reduced sulfated ash, phosphorus and sulfur content to meet ever increasingly restrictive environmental regulations. Such oils, known as low SAPS oils, would rely on the use of base stock(s) and/or base oil(s) which themselves, inherently, are of low or zero initial sulfur and phosphorus content. Such oils when used as base oils can be formulated with additives. Even if the additive or additives included in the formulation contain sulfur and/or phosphorus the resulting formulated lubricating oils will be lower or low SAPS oils as compared to lubricating oils formulated using conventional mineral oil base stocks.

Low SAPS formulated oils for vehicle engines (both spark ignited and compression ignited) will have a sulfur content of 0.7 wt % or less, preferably 0.6 wt % or less, more preferably 0.5 wt % or less, most preferably 0.4 wt % or less, an ash content of 1.2 wt % or less, preferably 0.8 wt % or less, more preferably 0.4 wt % or less, and a phosphorus content of 0.18% or less, preferably 0.1 wt % or less, more preferably 0.09 wt % or less, most preferably 0.08 wt % or less, and in certain instances, even preferably 0.05 wt % or less.

The preferred base stock(s) and/or base oil(s) derived from GTL materials and/or from waxy feeds is/are are characterized as having predominantly paraffinic compositions and are further characterized as having high saturates levels, low-to-nil sulfur, low-to-nil nitrogen, low-to-nil aromatics, and are essentially water-white in color.

The one or more hydrodewaxate or hydroisomerate base stock(s) and/or base oil(s), GTL base stock(s) and/or base oil(s), or mixtures thereof, preferably GTL base stock(s) and/or base oil(s) can constitute from 5 to 100%, preferably 40 to 100%, more preferably 70 to 100% by weight of the total of the base oil, the amount employed being left to the practitioner in response to the requirements of the finished lubricant.

In addition to the one or more hydrodewaxate or hydroisomerate base stock(s) and/or base oil(s), GTL base stock(s) and/or base oil(s), or mixtures thereof, preferably GTL base stock(s) and/or base oil(s) which is/are an essential, necessary component to achieve the unexpected improvement in both the initial and long term metal corrosion resistance, the base oil can contain natural oils as well as other synthetic oils and other non-conventional oils and mixtures thereof.

Natural oil, other synthetic oils, and other unconventional oils and mixtures thereof can be used unrefined, refined, or rerefined (the latter is also known as reclaimed or reprocessed oil). Unrefined oils are those obtained directly from a natural, synthetic or unconventional source and used without further purification. These include for example shale oil obtained directly from retorting operations, oils derived from coal, petroleum oil obtained directly from primary distillation, and ester oil obtained directly from an esterification process. Refined oils are similar to the oils discussed for unrefined oils except refined oils are subjected to one or more purification or transformation steps to improve at least one lubricating oil property. One skilled in the art is familiar with many purification or transformation processes. These processes include, for example, solvent extraction, secondary distillation, acid extraction, base extraction, filtration, percolation, hydrogenation, hydrorefining, and hydrofinishing. Rerefined oils are obtained by processes analogous to refined oils, but use an oil that has been previously used.

Groups I, II, III, IV and V are broad categories of base oil stocks developed and defined by the American Petroleum Institute (API Publication 1509; www.API.org) to create guidelines for lubricant base oils. Group I base stocks generally have a viscosity index of between about 80 to 120 and contain greater than about 0.03% sulfur and less than about 90% saturates. Group II base stocks generally have a viscosity index of between about 80 to 120, and contain less than or equal to about 0.03% sulfur and greater than or equal to about 90% saturates. Group III stock generally has a viscosity index greater than about 120 and contains less than or equal to about 0.03% sulfur and greater than about 90% saturates. Group IV includes polyalphaolefins (PAO). Group V base stocks include base stocks not included in Groups I-IV. Table A summarizes properties of each of these five groups.

TABLE A

| Base Stock Properties | | | |
|---|---|---|---|
| | Saturates | Sulfur | Viscosity Index |
| Group I | <90% and/or | >0.03% and | ≥80 and <120 |
| Group II | ≥90% and | ≤0.03% and | ≥80 and <120 |
| Group III | ≥90% and | ≤0.03% and | ≥120 |
| Group IV | Polyalphaolefins (PAO) | | |
| Group V | All other base oil stocks not included in Groups I, II, III, or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful in the present invention. Natural oils vary also as to the method used for their production and purification, for example, their distillation range and whether they are straight run or cracked, hydrorefined, or solvent extracted.

Synthetic oils include hydrocarbon oils as well as non hydrocarbon oils. Synthetic oils can be derived from processes such as chemical combination (for example, polymerization, oligomerization, condensation, alkylation, acylation, etc.), where materials consisting of smaller, simpler molecular species are built up (i.e., synthesized) into materials consisting of larger, more complex molecular species. Synthetic oils include hydrocarbon oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stock is a commonly used synthetic hydrocarbon oil. By way of example, PAO's derived from $C_8$, $C_{10}$, $C_{12}$, $C_{14}$ olefins or mixtures thereof may be utilized. See U.S. Pat. Nos. 4,956,122; 4,827,064; and 4,827,073.

The number average molecular weights of the PAO's, which are known materials and generally available on a major commercial scale from suppliers such as ExxonMobil Chemical Company, Chevron, BP-Amoco, and others, typically vary from about 250 to about 3000, or higher, and PAO's may be made in viscosities up to about 100 $mm^2/s$ (100° C.), or higher. In addition, higher viscosity PAO's are commercially available, and may be made in viscosities up to about 3000 $mm^2/s$ (100° C.), or higher. The PAO's are typically comprised of relatively low molecular weight hydrogenated polymers or oligomers of alpha-olefins which include, but are not limited to, about $C_2$ to about $C_{32}$ alpha-olefins with about $C_8$ to about $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins. However, the dimers of higher olefins in the range of about $C_{14}$ to $C_{18}$ may be used to provide low viscosity base stocks of acceptably low volatility. Depending on the viscosity grade and the starting oligomer, the PAO's may be predominantly trimers and tetramers of the starting olefins, with minor amounts of the higher oligomers, having a viscosity range of about 1.5 to 12 $mm^2/s$.

PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or U.S. Pat. No. 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

Other useful synthetic lubricating base stock oils such as silicon-based oil or esters of phosphorus containing acids may also be utilized. For examples of other synthetic lubricating base stocks are the seminal work "Synthetic Lubricants", Gunderson and Hart, Reinhold Publ. Corp., NY 1962.

In alkylated aromatic stocks such as mono- or poly-alkylbenzenes or mono- or poly-alkyl naphthalenes, the alkyl substituents are typically alkyl groups of about 8 to 25 carbon atoms, usually from about 10 to 18 carbon atoms and up to about three such substituents may be present, as described for the alkyl benzenes in ACS Petroleum Chemistry Preprint 1053-1058, "Poly n-Alkylbenzene Compounds: A Class of Thermally Stable and Wide Liquid Range Fluids", Eapen et al, Phila. 1984. Tri-alkyl benzenes may be produced by the cyclodimerization of 1-alkynes of 8 to 12 carbon atoms as described in U.S. Pat. No. 5,055,626. Other alkylbenzenes are described in European Patent Application 168 534 and U.S. Pat. No. 4,658,072. Alkylbenzenes are used as lubricant base stocks, especially for low-temperature applications (arctic vehicle service and refrigeration oils) and in papermaking oils. They are commercially available from producers of linear alkylbenzenes (LABs) such as Vista Chem. Co., Huntsman Chemical Co., Chevron Chemical Co., and Nippon Oil Co. Linear alkyl-benzenes typically have good low pour points and low temperature viscosities and VI values greater than about 100, together with good solvency for additives. Other alkylated aromatics which may be used when desirable are described, for example, in "Synthetic Lubricants and High Performance Functional Fluids", Dressler, H., chap 5, (R. L. Shubkin (Ed.)), Marcel Dekker, NY, 1993.

Alkylene oxide polymers and interpolymers and their derivatives containing modified terminal hydroxyl groups obtained by, for example, esterification or etherification are useful synthetic lubricating oils. By way of example, these oils may be obtained by polymerization of ethylene oxide or propylene oxide, the alkyl and aryl ethers of these polyoxyalkylene polymers (methyl-polyisopropylene glycol ether having an average molecular weight of about 1000, diphenyl ether of polyethylene glycol having a molecular weight of about 500-1000, and the diethyl ether of polypropylene glycol having a molecular weight of about 1000 to 1500, for example) or mono- and poly-carboxylic esters thereof (the acidic acid esters, mixed $C_{3-8}$ fatty acid esters, or the $C_{13}$Oxo acid diester of tetraethylene glycol, for example).

Esters comprise a useful base stock. Additive solvency and seal compatibility characteristics may be secured by the use of esters such as the esters of dibasic acids with monoalkanols and the polyol esters of mono-carboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those full or partial esters which are obtained by reacting one or more polyhydric alcohols (preferably the hindered polyols such as the neopentyl polyols e.g. neopentyl glycol, trimethylol ethane, 2-methyl-2-propyl-1,3-propanediol, trimethylol propane, pentaerythritol and dipentaerythritol) with alkanoic acids containing at least about 4 carbon atoms (preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid).

Suitable synthetic ester components include the esters of trimethylol propane, trimethylol butane, trimethylol ethane, pentaerythritol and/or dipentaerythritol with one or more monocarboxylic acids containing from about 5 to about 10 carbon atoms.

Silicon-based oils are another class of useful synthetic lubricating oils. These oils include polyalkyl-, polyaryl-, polyalkoxy-, and polyaryloxy-siloxane oils and silicate oils. Examples of suitable silicon-based oils include tetraethyl silicate, tetraisopropyl silicate, tetra-(2-ethylhexyl)silicate, tetra-(4-methylhexyl)silicate, tetra-(p-tert-butylphenyl)silicate, hexyl-(4-methyl-2-pentoxy)disiloxane, poly(methyl)siloxanes, and poly-(methyl-2-methylphenyl)siloxanes.

Another class of synthetic lubricating oil is esters of phosphorous-containing acids. These include, for example, tricresyl phosphate, trioctyl phosphate, diethyl ester of decane-phosphonic acid.

Another class of synthetic oils includes polymeric tetrahydrofurans, their derivatives, and the like.

Other useful fluids of lubricating viscosity include non-conventional or unconventional base stocks that have been processed, preferably catalytically, or synthesized to provide high performance lubrication characteristics.

In the present invention the lubricant compositions which have their initial and in use ferrous and/or non-ferrous metal corrosion resistance improved by the addition of one or more hydrodewaxate or hydroisomerate base stock(s) and/or base oil(s), GTL base stock(s) and/or base oil(s), or mixtures thereof, preferably GTL base stock(s) and/or base oil(s) as all or part of the base oil in combination with the surface active metal passivators in the lubricant, can contain one or more additional additives comprising anti-wear agent, antioxidant, viscosity modifier, viscosity index improvers, detergents, dispersants, anti-foamants, pour-point depressants, dyes, extreme pressure additives, anti-seizure agents, wax modifier, seal compatibility agents, friction modifiers, lubricity agents, anti-staining agents, chromophoric agents, demulsifiers, etc.

For a review of many commonly used additives see Klamann in "Lubricants and Related Products, Verlag Chemie, Deerfield Beach, Fla.; ISBN 0-89573-177-0, which also gives a good discussion of a number of the lubricant additives identified below. Reference is also made to "Lubricant Additives" by M. W. Ranney, published by Noyes Data Corporation of Parkridge, N.J. (1978).

Antiwear and EP Additives

Lubricating oils require the presence of antiwear and/or extreme pressure (EP) additives in order to provide adequate antiwear protection. Increasingly specifications for oil performance have exhibited a trend for improved antiwear properties of the oil. Antiwear and extreme EP additives perform this role by reducing friction and wear of metal parts.

While there are many different types of antiwear additives, for several decades the principal antiwear additive for internal combustion engine crankcase oils is a metal alkylthiophosphate and more particularly a metal dialkyldithiophosphate in which the primary metal constituent is zinc, or zinc dialkyldithiophosphate (ZDDP). ZDDP compounds generally are of the formula $Zn[SP(S)(OR^1)(OR^2)]_2$ where $R^1$ and $R^2$ are $C_1$-$C_{18}$ alkyl groups, preferably $C_2$-$C_{12}$ alkyl groups. These alkyl groups may be straight chain or branched. The ZDDP is typically used in amounts of from about 0.4 to 1.4 wt % of the total lube oil composition, although more or less can often be used advantageously.

However, it is found that the phosphorus from these additives has a deleterious effect on the catalyst in catalytic converters and also on oxygen sensors in automobiles when the formulations are used as engine oils. One way to minimize this effect is to replace some or all of the ZDDP with phosphorus-free antiwear additives.

A variety of non-phosphorous additives are also used as antiwear additives. Sulfurized olefins are useful as antiwear and EP additives. Sulfur-containing olefins can be prepared by sulfurization or various organic materials including aliphatic, arylaliphatic or alicyclic olefinic hydrocarbons containing from about 3 to 30 carbon atoms, preferably 3-20 carbon atoms. The olefinic compounds contain at least one non-aromatic double bond. Such compounds are defined by the formula $$R^3R^4C{=}CR^5R^6$$

where each of $R^3$-$R^6$ are independently hydrogen or a hydrocarbon radical. Preferred hydrocarbon radicals are alkyl or alkenyl radicals. Any two of $R^3$-$R^6$ may be connected so as to form a cyclic ring. Additional information concerning sulfurized olefins and their preparation can be found in U.S. Pat. No. 4,941,984.

The use of polysulfides of thiophosphorus acids and thiophosphorus acid esters as lubricant additives is disclosed in U.S. Pat. Nos. 2,443,264; 2,471,115; 2,526,497; and 2,591,577. Addition of phosphorothionyl disulfides as an antiwear, antioxidant, and EP additive is disclosed in U.S. Pat. No. 3,770,854. Use of alkylthiocarbamoyl compounds (bis(dibutyl)thiocarbamoyl, for example) in combination with a molybdenum compound (oxymolybdenum diisopropylphosphorodithioate sulfide, for example) and a phosphorous ester (dibutyl hydrogen phosphite, for example) as antiwear additives in lubricants is disclosed in U.S. Pat. No. 4,501,678. U.S. Pat. No. 4,758,362 discloses use of a carbamate additive to provide improved antiwear and extreme pressure properties. The use of thiocarbamate as an antiwear additive is disclosed in U.S. Pat. No. 5,693,598. Thiocarbamate/molybdenum complexes such as moly-sulfur alkyl dithiocarbamate trimer complex (R=$C_8$-$C_{18}$ alkyl) are also useful antiwear agents. The use or addition of such materials should be kept to a minimum if the object is to produce low SAP formulations.

Esters of glycerol may be used as antiwear agents. For example, mono-, di, and tri-oleates, mono-palmitates and mono-myristates may be used.

ZDDP is combined with other compositions that provide antiwear properties. U.S. Pat. No. 5,034,141 discloses that a combination of a thiodixanthogen compound (octylthiodixanthogen, for example) and a metal thiophosphate (ZDDP, for example) can improve antiwear properties. U.S. Pat. No. 5,034,142 discloses that use of a metal alkyoxyalkylxanthate (nickel ethoxyethylxanthate, for example) and a dixanthogen (diethoxyethyl dixanthogen, for example) in combination with ZDDP improves antiwear properties.

Preferred antiwear additives include phosphorus and sulfur compounds such as zinc dithiophosphates and/or sulfur, nitrogen, boron, molybdenum phosphorodithioates, molybdenum dithiocarbamates and various organo-molybdenum derivatives including heterocyclics, for example dimercaptothiadiazoles, mercaptobenzothiadiazoles, triazines, and the like, alicyclics, amines, alcohols, esters, diols, triols, fatty amides and the like can also be used. Such additives may be used in an amount of about 0.01 to 6 wt %, preferably about 0.01 to 4 wt %. ZDDP-like compounds provide limited hydroperoxide decomposition capability, significantly below that exhibited by compounds disclosed and claimed in this patent and can therefore be eliminated from the formulation or, if retained, kept at a minimal concentration to facilitate production of low SAP formulations.

Viscosity Index Improvers

Viscosity index improvers (also known as VI improvers, viscosity modifiers, and viscosity improvers) provide lubricants with high and low temperature operability. These additives impart shear stability at elevated temperatures and acceptable viscosity at low temperatures.

Suitable viscosity index improvers include high molecular weight hydrocarbons, polyesters and viscosity index improver dispersants that function as both a viscosity index improver and a dispersant. Typical molecular weights of these polymers are between about 10,000 to 1,000,000, more typically about 20,000 to 500,000, and even more typically between about 50,000 and 200,000.

Examples of suitable viscosity index improvers are polymers and copolymers of methacrylate, butadiene, olefins, or alkylated styrenes. Polyisobutylene is a commonly used viscosity index improver. Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

Viscosity index improvers may be used in an amount of about 0.01 to 8 wt %, preferably about 0.01 to 4 wt %.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197, for example.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant invention. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present invention include: p,p'-dioctyldiphenylamine; t-octylphenyl-alpha-naphthylamine; phenyl-alphanaphthylamine; and p-octylphenyl-alpha-naphthylamine.

Sulfurized alkyl phenols and alkali or alkaline earth metal salts thereof also are useful antioxidants.

Another class of antioxidant used in lubricating oil compositions is oil-soluble copper compounds. Any oil-soluble suitable copper compound may be blended into the lubricating oil. Examples of suitable copper antioxidants include copper dihydrocarbyl thio or dithio-phosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are know to be particularly useful.

Preferred antioxidants include hindered phenols, arylamines. These antioxidants may be used individually by type or in combination with one another. Such additives may be used in an amount of about 0.01 to 5 wt %, preferably about 0.01 to 1.5 wt %, more preferably zero to less than 1.5 wt %, most preferably zero.

Detergents

Detergents are commonly used in lubricating compositions. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur acid, carboxylic acid, phosphorous acid, phenol, or mixtures thereof. The counterion is typically an alkaline earth or alkali metal.

Salts that contain a substantially stoichiometric amount of the metal are described as neutral salts and have a total base number (TBN, as measured by ASTM D2896) of from 0 to 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased.

It is desirable for at least some detergent to be overbased. Overbased detergents help neutralize acidic impurities produced by the combustion process and become entrapped in the oil. Typically, the overbased material has a ratio of metallic ion to anionic portion of the detergent of about 1.05:1 to 50:1 on an equivalent basis. More preferably, the ratio is from about 4:1 to about 25:1. The resulting detergent is an overbased detergent that will typically have a TBN of about 150 or higher, often about 250 to 450 or more. Preferably, the overbasing cation is sodium, calcium, or magnesium. A mixture of detergents of differing TBN can be used in the present invention.

Preferred detergents include the alkali or alkaline earth metal salts of sulfonates, phenates, carboxylates, phosphates, and salicylates.

Sulfonates may be prepared from sulfonic acids that are typically obtained by sulfonation of alkyl substituted aromatic hydrocarbons. Hydro-carbon examples include those obtained by alkylating benzene, toluene, xylene, naphthalene, biphenyl and their halogenated derivatives (chlorobenzene, chlorotoluene, and chloronaphthalene, for example). The alkylating agents typically have about 3 to 70 carbon atoms. The alkaryl sulfonates typically contain about 9 to about 80 carbon or more carbon atoms, more typically from about 16 to 60 carbon atoms.

Klamann in "Lubricants and Related Products", op cit discloses a number of overbased metal salts of various sulfonic acids which are useful as detergents and dispersants in lubricants. The book entitled "Lubricant Additives", C. V. Smallheer and R. K. Smith, published by the Lezius-Hiles Co. of Cleveland, Ohio (1967), similarly discloses a number of overbased sulfonates that are useful as dispersants/detergents.

Alkaline earth phenates are another useful class of detergent. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids are also useful as detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates. One useful family of compositions is of the formula

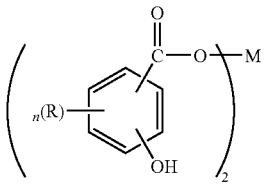

where R is a hydrogen atom or an alkyl group having 1 to about 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, or barium. More preferably, M is calcium.

Hydrocarbyl-substituted salicylic acids may be prepared from phenols by the Kolbe reaction (see U.S. Pat. No. 3,595,791). The metal salts of the hydrocarbyl-substituted salicylic acids may be prepared by double decomposition of a metal salt in a polar solvent such as water or alcohol.

Alkaline earth metal phosphates are also used as detergents.

Detergents may be simple detergents or what is known as hybrid or complex detergents. The latter detergents can provide the properties of two detergents without the need to blend separate materials. See U.S. Pat. No. 6,034,039 for example.

Preferred detergents include calcium phenates, calcium sulfonates, calcium salicylates, magnesium phenates, magnesium sulfonates, magnesium salicylates and other related components (including borated detergents). Typically, the total detergent concentration is about 0.01 to about 6.0 wt %, preferably, about 0.1 to 0.4 wt %.

Dispersant

During engine operation, oil-insoluble oxidation byproducts are produced. Dispersants help keep these byproducts in solution, thus diminishing their deposition on metal surfaces. Dispersants may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

Chemically, many dispersants may be characterized as phenates, sulfonates, sulfurized phenates, salicylates, naphthenates, stearates, carbamates, thiocarbamates, phosphorus derivatives. A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between alkenyl succinic anhydrides and amines. Molar ratios can vary depending on the poly-amine. For example, the molar ratio of alkenyl succinic anhydride to TEPA can vary from about 1:1 to about 5:1. Representative examples are shown in U.S. Pat. Nos. 3,087,936; 3,172,892; 3,219,666; 3,272,746; 3,322,670; and 3,652,616, 3,948,800; and Canada Pat. No. 1,094,044.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the alkenyl succinic anhydrides used in the preceding paragraphs will typically range between 800 and 2,500. The above products can be post-reacted with various reagents such as sulfur, oxygen, formaldehyde, carboxylic acids such as oleic acid, and boron compounds such as borate esters or highly borated dispersants. The dispersants can be borated with from about 0.1 to about 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this invention can be prepared from high molecular weight alkyl-substituted hydroxyaromatics or $HN(R)_2$ group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as $BF_3$, of phenol with high molecular weight polypropylene, polybutylene, and other polyalkylene compounds to give alkyl substituents on the benzene ring of phenol having an average 600-100,000 molecular weight.

Examples of $HN(R)_2$ group-containing reactants are alkylene poly-amines, principally polyethylene polyamines. Other representative organic compounds containing at least one $HN(R)_2$ group suitable for use in the preparation of Mannich condensation products are well known and include the mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamide reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, and decaethylene undecamine and mixture of such amines having nitrogen contents corresponding to the alkylene polyamines, in the formula $H_2N—(Z—NH—)_nH$, mentioned before, Z is a divalent ethylene and n is 1 to 10 of the foregoing formula. Corresponding propylene polyamines such as propylene diamine and di-, tri-, tetra-, pentapropylene tri-, tetra-, penta- and hexaamines are also suitable reactants. The alkylene poly-amines are usually obtained by the reaction of ammonia and dihalo alkanes, such as dichloro alkanes. Thus the alkylene polyamines obtained from the reaction of 2 to 11 moles of ammonia with 1 to 10 moles of dichloroalkanes having 2 to 6 carbon atoms and the chlorines on different carbons are suitable alkylene polyamine reactants.

Aldehyde reactants useful in the preparation of the high molecular products useful in this invention include the aliphatic aldehydes such as formaldehyde (also as paraformaldehyde and formalin), acetaldehyde and aldol (β-hydroxybutyraldehyde). Formaldehyde or a formaldehyde-yielding reactant is preferred.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000 or a mixture of such hydrocarbylene groups. Other preferred dispersants include succinic acid-esters and amides, alkylphenol-polyamine-coupled Mannich adducts, their capped derivatives, and other related components. Such additives may be used in an amount of about 0.1 to 20 wt %, preferably about 0.1 to 8 wt %.

Pour Point Depressants

Conventional pour point depressants (also known as lube oil flow improvers) may be added to the compositions of the present invention if desired. These pour point depressant may be added to lubricating compositions of the present invention to lower the minimum temperature at which the fluid will flow or can be poured. Examples of suitable pour point depressants include poly-methacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655, 479; 2,666,746; 2,721,877; 2,721,878; and 3,250,715 describe useful pour point depressants and/or the preparation thereof. Such additives may be used in an amount of about 0.01 to 5 wt %, preferably about 0.01 to 1.5 wt %.

Seal Compatibility Additives

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 to 3 wt %, preferably about 0.01 to 2 wt %.

Anti-Foam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 percent and often less than 0.1 percent.

Friction Modifiers

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present invention if desired. Friction modifiers that lower the coefficient of friction are particularly advantageous in combination with the base oils and lube compositions of this invention. Friction modifiers may include metal-containing compounds or materials as well as ashless compounds or materials, or mixtures thereof. Metal-containing friction modifiers may include metal salts or metal-ligand complexes where the metals may include alkali, alkaline earth, or transition group metals. Such metal-containing friction modifiers may also have low-ash characteristics. Transition metals may include Mo, Sb, Sn, Fe, Cu, Zn, and others. Ligands may include hydrocarbyl derivative of alcohols, polyols, glycerols, partial ester glycerols, thiols, carboxylates, carbamates, thiocarbamates, dithiocarbamates, phosphates, thiophosphates, dithiophosphates, amides, imides, amines, thiazoles, thiadiazoles, dithiazoles, diazoles, triazoles, and other polar molecular functional groups containing effective amounts of O, N, S, or P, individually or in combination. In particular, Mo-containing compounds can be particularly effective such as for example Mo-dithiocarbamates, Mo(DTC), Mo-dithiophosphates, Mo(DTP), Mo-amines, Mo (Am), Mo-alcoholates, Mo-alcohol-amides, etc. See U.S. Pat. No. 5,824,627; U.S. Pat. No. 6,232,276; U.S. Pat. No. 6,153,564; U.S. Pat. No. 6,143,701; U.S. Pat. No. 6,110,878; U.S. Pat. No. 5,837,657; U.S. Pat. No. 6,010,987; U.S. Pat. No. 5,906,968; U.S. Pat. No. 6,734,150; U.S. Pat. No. 6,730,638; U.S. Pat. No. 6,689,725; U.S. Pat. No. 6,569,820; WO 99/66013; WO 99/47629; WO 98/26030.

Ashless friction modifiers may have also include lubricant materials that contain effective amounts of polar groups, for example, hydroxyl-containing hydrocarbyl base oils, glycerides, partial glycerides, glyceride derivatives, and the like. Polar groups in friction modifiers may include hydrocarbyl groups containing effective amounts of O, N, S, or P, individually or in combination. Other friction modifiers that may be particularly effective include, for example, salts (both ash-containing and ashless derivatives) of fatty acids, fatty alcohols, fatty amides, fatty esters, hydroxyl-containing carboxylates, and comparable synthetic long-chain hydrocarbyl acids, alcohols, amides, esters, hydroxy carboxylates, and the like. In some instances fatty organic acids, fatty amines, and sulfurized fatty acids may be used as suitable friction modifiers.

Useful concentrations of friction modifiers may range from about 0.01 wt % to 10-15 wt % or more, often with a preferred range of about 0.1 wt % to 5 wt %. Concentrations of molybdenum-containing materials are often described in terms of Mo metal concentration. Advantageous concentrations of Mo may range from about 10 ppm to 3000 ppm or more, and often with a preferred range of about 20-2000 ppm, and in some instances a more preferred range of about 30-1000 ppm. Friction modifiers of all types may be used alone or in mixtures with the materials of this invention. Often mixtures of two or more friction modifiers, or mixtures of friction modifier(s) with alternate surface active material(s), are also desirable.

Typical Additive Amounts

When lubricating oil compositions contain one or more of the additives discussed above, the additive(s) are blended into the composition in an amount sufficient for it to perform its intended function. Typical amounts of such additives useful in the present invention are shown in Table 1 below.

Note that many of the additives are shipped from the manufacturer and used with a certain amount of base oil solvent in the formulation. Accordingly, the weight amounts in the table below, as well as other amounts mentioned in this specification, are directed to the amount of active ingredient (that is the non-solvent portion of the ingredient). The wt % indicated below are based on the total weight of the lubricating oil composition.

TABLE B

Typical Amounts of Various Lubricant Oil Components

| Compound | Approximate wt % (Useful) | Approximate wt % (Preferred) |
|---|---|---|
| Detergent | 0.01-6 | 0.01-4 |
| Dispersant | 0.1-20 | 0.1-8 |
| Friction Reducer | 0.01-5 | 0.01-1.5 |
| Viscosity Index Improver | 0.0-40 | 0.01-30, more preferably 0.01-15 |
| Antioxidant | 0.1-5 | 0.1-1.5 |
| Anti-wear Additive | 0.01-6 | 0.01-4 |
| Pour Point Depressant | 0.0-5 | 0.01-1.5 |
| Anti-foam Agent | 0.001-3 | 0.001-0.15 |
| Base Oil | Balance | Balance |

Corrosion Inhibitors

Corrosion inhibitors which are necessary components of the present invention can be described as any materials (additives, functionalized fluids, etc.) that form a protective film on a surface that prevents corrosion agents from reacting or attacking that surface with a resulting loss of surface material. Protective films may be absorbed on the surface or chemically bonded to the surface. Protective films may be constituted from mono-molecular species, oligomeric species, polymeric species, or mixtures thereof. Protective films may derive from the intact corrosion inhibitors, from their combination products, or their degradation products, or mixtures thereof. Surfaces that may benefit from the action of corrosion inhibitors may include metals and their alloys (both ferrous and non-ferrous types) and non-metals. Corrosion inhibitors used to protect metals may also be called metal passivators or metal deactivators. Corrosion inhibitors may include rust inhibitors, which are particularly useful for the protection of ferrous metals and their alloys. Selected corrosion inhibitors may be particularly useful in protecting non-ferrous metals, for example copper and its alloys.

Corrosion inhibitors may include various oxygen-, nitrogen-, sulfur-, and phosphorus-containing materials, and may include metal-containing compounds (salts, organometallics, etc.) and nonmetal-containing or ashless materials. Corrosion inhibitors may include, but are not limited to, additive types such as, for example, hydrocarbyl-, aryl-, alkyl-, arylalkyl-, and alkylaryl-versions of detergents (neutral, overbased), sulfonates, phenates, salicylates, alcoholates, carboxylates, salixarates, phosphites, phosphates, thiophosphates, amines, amine salts, amine phosphoric acid salts, amine sulfonic acid salts, alkoxylated amines, etheramines, polyetheramines, amides, imides, azoles, diazoles, triazoles, benzotriazoles, benzothiadoles, mercaptobenzothiazoles, tolyltriazoles (TTZ-type), heterocyclic amines, heterocyclic sulfides, thiazoles, thiadiazoles, mercaptothiadiazoles, dimercaptothiadiazoles (DMTD-type), imidazoles, benzimidazoles, dithiobenzimidazoles, imidazolines, oxazolines, Mannich reactions products, saligenin derivatives, glycidyl ethers, anhydrides, carbamates, thiocarbamates, dithiocarbamates, polyglycols, etc., or mixtures thereof.

Corrosion agents may derive from many sources, for example from one or more components (additives and/or base stocks) within a finished lubricant composition, from degradation products accumulated in a lubricant fluid during lubricant service, from outside contaminants accumulated in a lubricant fluid during lubricant service, and so forth. Corrosion agents may include, but are not limited to, for example thiols, mercaptans, sulfides, di-, tri-, poly-sulfides, mineral acids, hydrocarbon acids, carboxylic acids, nitrogen-derived acids, sulfur-derived acids, phosphorus-derived acids, oxidized and/or nitrated hydrocarbons, oxidized and/or nitrated lube products, fuel combustion products, lubricating fluid contaminants, oxidized and/or nitrated soots, etc.

Corrosion inhibitors are used to reduce the degradation of metallic parts that are in contact with the lubricating oil composition. Suitable corrosion inhibitors include thiadiazoles. See, for example, U.S. Pat. Nos. 2,179,125; 2,719,126; and 3,087,932. Aromatic triazoles, such as toly triazole, are suitable corrosion inhibitors for non-ferrous metals, such as copper.

Corrosion inhibitor additives may be used in an amount of about 0.001 to 5 wt %, preferably about 0.01 to 1.5 wt %, more preferably about 0.15 to 1.0 wt %, still more preferably about 0.2 to 0.6 wt %, even more preferably about 0.2 to 0.5 wt %, most preferably about 0.3 to 0.5 wt % active ingredient, relative to the weight of the total lubricant composition. When the formulations in which the corrosion inhibitor additives are used also contain corrosive anti-wear additives or other corrosive additives, the corrosive additives and corrosion inhibitors are present at a corrosive additive to corrosion inhibitor weight ratio of about 45:1 to 1:1, preferably 30:1 to 1:1, more preferably 15:1 to 1:1, still more preferably about 15:1 to 3:1, even more preferably about 15:2 to 3:1.

Aviation engine piston oils are special cases and are formulated with ashless additives and must meet the SAE J 1966 and SAE J 1899 specifications for non dispersant and ashless dispersant oils respectively.

The aviation piston engine oil composition contains an ashless dispersant such as a polybutene succinic anhydride reaction product with a polyalkyl polyamine. Other ashless dispersants such as polymethacrylate esters containing nitrogen could also be used. The amount of ashless dispersant should be at least 2 wt % of total weight lubricating oil composition.

The aviation piston engine oil composition usually also comprises additional additives such as one or more antiwear agents, antioxidants, extreme pressure agents, corrosion inhibitors, viscosity index (VI) improvers, pour point depressants, antifoams. Suitable antiwear agents include tricresyl phosphates such as Durad 125, alkylated aryl phosphates Syn O Ad 8484 and the like. The amount of antiwear agents is in the range from about 0.5 to about 4 wt % of the total weight of the lubricating oil composition.

Suitable antioxidants comprises of hindered phenols such as Irganox L 135, Irganox 1010 and alkylated diphenyl amines such as Naugalube 438L, Vanlube 81 or a mixture thereof. The amount of antioxidants range from about 0.2 to about 4 wt % of the total weight of lubricating oil composition.

An extreme pressure agent useful in this invention comprise of dialkyl dimercapto thiadiazoles such as Hitec 4313. The amount of extreme pressure agents range from about 0.1 to about 0.5 wt % of total weight of lubricating oil composition.

Corrosion inhibitors useful in this invention include benzotraizole, and tolyltriazoles such as Cobratec TT-100. In the aviation piston engine oil embodiment of the present invention, the preferred amount of corrosion inhibitors ranges from about 0.05 to about 0.2 wt % of the total weight of lubricating oil composition.

Viscosity index improvers suitable in this invention comprise of polyacrylate esters, polymethacrylate esters and ethylene-propylene, butadiene-styrene copolymers and the like. The amount of VI improver ranges from about 2 to about 10 wt % of total weight of lubricating oil composition.

Pour point depressants suitable in this invention comprise of poly-methacrylate esters, alkyl fumarate-vinyl acetate copolymers such as Infineum V385 and Infineum V387. The amount of pour point depressants range from about 0.1 to about 1.0 wt % of the total weight of lubricating oil composition.

The aviation piston engine oil composition may also contain from 0 to about 20 ppm of antifoam additive selected from acrylate esters or polyalkyl siloxanes.

EXAMPLES

Example 1

In the following Example presented in Tables 1-5 the metal corrosion test is ASTM D130 copper corrosion test, the ASTM visual rating basis being outlined in Table C.

TABLE C

| Copper Corrosion D130 Corrosion Test Rating Scales (ASTM D130) | |
|---|---|
| ASTM Visual Rating | Description |
| 1A | Light Varnish |
| 1B | |
| 2A | Moderate Varnish |
| 2B | |
| 2C | |
| 2D | |
| 2E | |
| 3A | Dark Varnish |
| 3B | |
| 4A | Corrosion |
| 4B | |
| 4C | |

Lubricant compositions (Table 2) of Fischer-Tropsch wax isomerate lube, slack wax isomerate lube and other base oils and corrosion inducing anti-wear additive (e.g., sulfurized olefin) and metal passivators (e.g., a tolytriazole (TTZ-type) and a dimercaptothiadiazole (DMTD-type)) span a range of additive concentrations.

These lubricant compositions demonstrate the improved performance of the Fischer-Tropsch isomerate lube (GTL type) and slack wax isomerate lube base oils (hydrodewaxate or hydroisomerate type) in combination with corrosion inducing anti-wear and metal passivator additives (Tables 3-5):

improved corrosion protection at TTZ-type additive concentration, about 0.05 wt % and higher, or improved corrosion protection at DMTD-type additive concentration, about 0.05 wt % and higher.

(e.g., 3 hours), but also, over time, the formulations utilizing hydrodewaxate or hydroisomerate base stock/GTL base stock exhibited reduced/lower metal corrosion tendencies when compared to formulation utilizing other base stock types.

In those formulations containing both corrosion anti wear additives and metal passivators the utilization of wax isomerate base stock/GTL base stock as base stock is most notable in formulation containing both anti-wear additives and metal passivators at anti-wear additive/metal passivator weight ratios of about 45:1 to 1:1, preferable 30:1 to 1:1, more preferably 15:1 to 1:1, still more preferably about 15:1 to 3:1, even more preferably about 15:2 to 3:1.

TABLE 1

| Base Stock Descriptions | | | |
|---|---|---|---|
| Base Stocks | Description | KV @ 100° C., $mm^2/s$ | Viscosity Index (VI) |
| GTL 6 | Gas-to-Liquid Wax Isomerate | 6.0 | 156 |
| GTL 14 | Gas-to-Liquid Wax Isomerate | 14.4 | 155 |
| SPN 100 & 600 (63:37) | Group I | 5.9 | 104 |
| SPN 600 | Group I | 12.2 | 96 |
| Bright Stock | Group I | 31.8 | 96 |
| XHVI 5 | Group III | 5.1 | 148 |
| Yubase 4 & 6 (18:82) * | Group III | 5.7 | 131 |
| Visom 4 & 6 (18:82) ** | Group III | 6.0 | 142 |
| PAO 6 | Group IV (PAO) | 5.8 | 137 |
| PAO 6 & 8 (85:15) | Group V (PAO) | 6.1 | 137 |

* A hydrocracked, isomerized base oil made using a catalytic isodewaxing process according to U.S. Pat. No. 5,580,442

** Slack wax isomerate according to WO 93/33320.

TABLE 2

| Formulation, Wt % | | | | | | | | | | |
|---|---|---|---|---|---|---|---|---|---|---|
| Lubricant Compositions | 2a | 2b | 2c | 2d | 2e | 2f | 2g | 2h | 2i | 2j |
| Base Stock(s) | 100 | 98.45 | 98.4 | 98.3 | 98.0 | 98.45 | 98.4 | 98.3 | 98.0 | 98.5 |
| Sulfurized Olefin | | 1.5 | 1.5 | 1.5 | 1.5 | 1.5 | 1.5 | 1.5 | 1.5 | 1.5 |
| TTZ-type Passivator | | 0.025 | 0.05 | 0.1 | 0.25 | | | | | |
| DMTD type Passivator | | | | | | 0.05 | 0.1 | 0.2 | 0.5 | |
| Total Weight %: | 100 | 100 | 100 | 100 | 100 | 100 | 100 | 100 | 100 | 100 |
| Relative Ratio Sulfurized Additive-to-Passivator | | 60:1 | 30:1 | 15:1 | 6:1 | 30:1 | 15:1 | 15:2 | 3:1 | |

Compositions containing the isomerate base stock(s)/GTL base stock(s) perform better than those containing mineral oil, PAO, and alternate Group II/Group III base oils.

In these examples corrosion inducing anti-wear additives were present, representative of those formulations which exhibit corrosion tendencies by their very nature even when fresh. What is demonstrated for such oils is believed to be representative of the benefit of using wax isomerate base stock(s), GTL base stock(s) as base stock in formulations containing metal passivator additives in corrosive environments in comparison to using other base oils in term of the unexpected improvements in residence to corrosion shown by the formulations employing wax isomerate base stock(s), GTL base stock(s) as base stocks.

The metal corrosion tendency exhibited by the formulations containing wax isomerate base oil/GTL base oil as base stock are at least equivalent to, if not superior to the corrosion tendencies shown by other stocks when tested as fresh oils

TABLE 3

| Copper Corrosion, D130 Test (250° F., 3 hours) | | | | | | | | | | |
|---|---|---|---|---|---|---|---|---|---|---|
| | Examples | | | | | | | | | |
| | 3a | 3b | 3c | 3d | 3e | 3f | 3g | 3h | 3i | 3j |
| Base Stocks | D130 (250° F., 3 hours)/ASTM Ratings | | | | | | | | | |
| GTL 6 | 2A | 1B | 1B | 1B | 1B | 1B | 1B | 1B | 1B | 2A |
| SPN 100 & 600 (63:37) | 1A | 1B | 1B | 1B | 1B | 2E | 2E | 1B | 1B | 3A |
| XHVI 5 | 1B | 1B | 1B | 1B | 1B | 3B | 3B | 2A | 2A | 3B |
| Yubase 4 & 6 (18:82) | 1B | 1B | 1B | 1B | 1B | 1B | 1B | 1B | 1B | 2A |
| Visom 4 & 6 (18:82) | 2B | 1B | 1B | 1B | 1B | 1B | 1B | 1B | 1B | 3B |
| PAO 6 & 8 (85:15) | 2A | 1B | 1B | 1B | 1B | 1B | 1B | 1B | 1B | 2A |

Note:

Lower Number and Lower Letter Ratings Indicate Lower Corrosion

TABLE 4

| Copper Corrosion, D130 Test (250° F., 24 hours) | | | | | | | | | | |
|---|---|---|---|---|---|---|---|---|---|---|
| | Examples | | | | | | | | | |
| | 4a | 4b | 4c | 4d | 4e | 4f | 4g | 4h | 4i | 4j |
| Base Stocks | D130 (250° F., 24 hours)/ASTM Ratings | | | | | | | | | |
| GTL 6 | 2B | 1B | 1B | 1B | 2A | 4A | 2E | 2B | 2A | 4B |
| SPN 100 & 600 (63:37) | 3B | 2B | 1B | 1B | 1B | 4A | 4A | 3A | 2B | 4B |
| XHVI 5 | 2A | 2E | 2B | 1B | 2A | 4A | 4A | 3A | 2E | 4A |
| Yubase 4 & 6 (18:82) | 2A | 2A | 2A | 1B | 1B | 4A | 3B | 3B | 2A | 4B |
| Visom 4 & 6 (18:82) | 2B | 2A | 2A | 1B | 1B | 4A | 4A | 2A | 2A | 4B |
| PAO 6 & 8 (85:15) | 2B | 2A | 2A | 1B | 1B | 4B | 3B | 2B | 2A | 4B |

Note:
Lower Number and Lower Letter Ratings Indicate Lower Corrosion

TABLE 5

| Copper Corrosion, D130 Test (250° F., 48 hours) | | | |
|---|---|---|---|
| | Examples | | |
| | 5d | 5e | 5i |
| Base Stocks | D130 (250° F., 48 hours)/ASTM Ratings | | |
| GTL 6 | 3A | 2C | 2E |
| SPN 100 & 600 (63:37) | 3B | 3B | 3B |
| XHVI 5 | 3A | 3A | 3B |
| Yubase 4 & 6 (18:82) | 3A | 2B | 2E |
| Visom 4 & 6 (18:82) | 3A | 2A | 2E |
| PAO 6 & 8 (85:15) | 3A | 3A | 2E |

Note:
Lower Number and Lower Letter Ratings Indicate Lower Corrosion

Example 2

Four aviation piston engine lubricants were prepared by blending the base oils and additives listed in Table 6. Two lubricants (Lube-1 and Lube-2) were prepared with Group I mineral base stock and Fischer-Tropsch was hydroisomerized base stocks. The third lubricant (Lube-3) was prepared with Group I mineral base stock, the Fischer-Tropsch was hydroisomerized base stock and PAO. The fourth lubricant was prepared with Group I mineral base stocks and PAO (Lube-4). The results were compared with aviation piston engine oil AeroShell Oil 15W50 lubricant (Lube-5). The AeroShell Oil 15W50 comprises mineral oil base stocks, PAO and performance additives.

TABLE 6

| Component (by weight %) | Lube-1 | Lube-2 | Lube-3 | Lube-4 |
|---|---|---|---|---|
| GTL 14 | 30.34 | 0 | 30.27 | 0 |
| GTL 6 | 26.61 | 26.280 | 0 | 0 |
| SPN 600 | 0 | 29.97 | 0 | 29.65 |
| Bright Stock | 30.40 | 30.02 | 30.33 | 29.700 |
| PAO 6 | 0 | 0 | 26.55 | 26.000 |
| Tolyltriazole | 0.05 | 0.05 | 0.05 | 0.05 |
| Tricresyl Phosphate | 1.50 | 1.50 | 1.50 | 1.50 |
| Balance of Additives[(1)] | 11.1 | 12.18 | 11.3 | 13.1 |

[(1)]Phenolic anti-oxidant, aminic anti-oxidant, ashless dispersant, VI improver, extreme pressure additive, antifoamant.

In Table 6 the level of VI improver was adjusted to meet a kinematic viscosity target of 20 $mm^2/s$ at 100° C.

Example 3

This example shows (Table 7) that the lubricants containing the GTL (Gas to Liquid) base stocks and no PAO (Lube-1 and Lube-2) exhibit similar deposit tendency by the Hot Tube Test (24 hours @ 285° C.) as Lube-4 comprising of Group I mineral base stocks and PAO. The presence of PAO (Lube-3) in the lubricant oil composition directionally degrades the deposit tendency from 6.5 rating to 7.0., but this could possibly be attributable to test repeatability.

All the lubricant oil compositions containing the GTL base stock exhibit significantly lower deposit (6.5 to 7.0 rating) than the AeroShell Oil 15W50 (8.5 rating), designated Lube-5, in Table 7. In the Hot Tube test, the oil is pumped through a glass tube heated in a furnace at 285° C. After the test, the glass tube is visually rated. A rating of 0 correspond to a clean glass tube whereas a rating of 10 corresponds to a very dark brown coloration.

TABLE 7

| Hot Tube Test, 24 hours @ 285° C. | |
|---|---|
| Lubricants | Tube Rating |
| Lube-1 | 6.5 |
| Lube-2 | 6.5 |
| Lube-3 | 7.0 |
| Lube-4 | 6.0 |
| Lube-5 | 8.5 |

Example 4

This example shows that the lubricant oil compositions containing the GTL base stocks (Lube-1, Lube-2 and Lube-3) gave better Cold Crankase Simulator (CCS) performance by ASTM D 5293 and similar Pour Point (ASTM D97) than the lubricant composition containing only the Group I mineral base stock and the PAO (Lube-4). The Mini Rotary Viscometer (ASTM D 4684) gave higher viscosity for Lubes-1, -2 and -3 as compared against Lube-4, at −20° C. but this could be improved by optimization of the base stock composition and addition of pour point depressant. Same additive adpack was used in all cases (see Example 2, Table 6).

TABLE 8

| Lubricants | Pour Point, ° C. | CCS @ −15° C., cP | MRV @ −20° C., cP |
|---|---|---|---|
| Lube-1 | −21 | 4670 | 48043 |
| Lube-2 | −21 | 7230 | 522024 |
| Lube-3 | −24 | 4920 | 30393 |
| Lube-4 | −21 | 7590 | 19473 |

Example 5

This example illustrates the improved viscometric properties (higher VI) of the lubricating oil composition containing the GTL base stocks (Lube-1, Lube-2 and Lube-3) as compared with the lubricating oil composition containing only the PAO (Lube-4). Lube-1, Lube-2 and Lube-3 required less VI improver to obtain a target kinematic viscosity of about 19 $mm^2/s$ which suggests the lubricating oil compositions should be more shear stable.

TABLE 9

| Properties | Lube-1 | Lube-2 | Lube-3 | Lube-4 |
|---|---|---|---|---|
| KV @ 40° C., $mm^2/s$ | 143.5 | 163.9 | 152.2 | 180.8 |
| KV @ 100° C., $mm^2/s$ | 18.72 | 19.1 | 19.25 | 19.81 |

TABLE 9-continued

| Properties | Lube-1 | Lube-2 | Lube-3 | Lube-4 |
|---|---|---|---|---|
| Viscosity Index | 148 | 133 | 145 | 127 |
| Sulfur, wt % | 0.326 | 0.430 | 0.321 | 0.416 |

Example 6

In this example the rust protection performance of the lubricating oil composition containing the GTL base stocks (Lube-1, Lube-2 and Lube-3) is maintained as compared with the lubricating oil composition containing only the PAO (Lube-4). Also the rust protection performance of Lube-1, Lube-2 and Lube-3 is better than the competitive oil Aero-Shell Oil 15W50 (Lube-5) as measured by a visual estimation of the rust coverage on the surface of the tappet. The rust performance was evaluated by the Humidity Cabinet Rust Test (ASTM D 1748) at 120° F., 100% relative humidity for 72 hours. Aircraft tappets were used instead of metal panels. A rating of 0 is a perfectly clean surface whereas a rating of 10 correspond to total rust coverage of the surface area of the tappet.

TABLE 10

| 120° F., 100% RH, 72 hours | |
|---|---|
| Lubricant | Rating |
| Lube-1 | 0.5 |
| Lube-2 | 1.0 |
| Lube-3 | 0.5 |
| Lube-4 | 1.0 |
| Lube-5 | 2.0 |

What is claimed is:

1. An aviation piston engine oil comprising (i) a base oil comprising:

(a) from about 30.27 to 56.95 wt % based on the total weight of the base oil of one or more GTL base stock(s) and/or base oil(s), having a kinematic viscosity at 100° C. in the range of about 10 to 14 $mm^2/s$;

(b) about 30 wt % based on the total weight of the base oil of Bright Stock;

(c) about zero to 26.6 wt % based on the total weight of the base oil of polyalpha olefin having a kinematic viscosity at 100° C. of about 6 $mm^2/s$; and (d) with the proviso that the base oil is essentially free of Solvent Paraffinic Neutral (SPN) 600 mineral oil;

(ii) about 11 wt % of additive comprising one or more of viscosity index improver, anti-oxidant, anti-foam agent, dye, ashless dispersant, extreme pressure additive;

(iii) both an anti-wear additive and an anti-corrosion additive in the weight ratio of from about 30:1, wherein the anti-wear additive comprises tricresyl phosphate at about 1.50 wt. % based on the total weight of the engine oil and wherein the anti-corrosion additive comprises tolytriazole at about 0.05 wt. % based on the total weight of the engine oil; and (iv) wherein said oil is formulated with additives to meet SAE-J 1966 and SAE-J 1899 specifications for nondispersant and ashless dispersant oils respectively, and wherein the humidity cabinet rust test rating (ASTM D 1748 at 120° F., 100% relative humidity for 72 hours) of said oil is about 0.5 or less.

2. The aviation piston engine of claim 1 wherein the additive (ii) comprises at least 2 wt % ashless dispersant based on the total weight of the engine oil.

3. The aviation piston engine oil of claim 1 or 2 wherein the one or more GTL base stock(s) and/or base oil(s) is a mixture of at least two of said base stock of (i)(a) wherein one of the base stock(s) has a KV of about 6 to 14 $mm^2/s$.

4. The aviation piston engine oil of claim 3 wherein the mixture of at least two of said base stock(s) and/or base oil(s) of (i)(a), one of the base stock(s) and/or base oil(s) has a KV of about 12 to 14 $mm^2/s$.

5. The aviation piston engine oil of claim 1 or 2 wherein the base stock and/or base oil (i)(a) constitutes at least 50 wt % of the total base oil.

6. The aviation piston engine oil of claim 1 or 2 wherein the base stock and/or base oil (i)(a) constitutes at least 40 wt % of the total base oil.

7. The aviation piston engine oil of claim 1 wherein the oil has improved rust performance as measured by ASTM D 1748 when compared to a piston oil further including SPN 600 mineral oil base stock.

* * * * *